US009150343B2

(12) United States Patent
Roberts

(10) Patent No.: US 9,150,343 B2
(45) **Date of Patent: *Oct. 6, 2015**

(54) SUSPENSION PACKAGING ASSEMBLY

(71) Applicant: Larry Roberts, Ft. Lauderdale, FL (US)

(72) Inventor: Larry Roberts, Ft. Lauderdale, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/230,158

(22) Filed: Mar. 31, 2014

(65) Prior Publication Data

US 2014/0246352 A1 Sep. 4, 2014

Related U.S. Application Data

(63) Continuation-in-part of application No. 13/417,919, filed on Mar. 12, 2012, now Pat. No. 8,727,123.

(60) Provisional application No. 61/464,889, filed on Mar. 11, 2011.

(51) Int. Cl.
*B65D 81/07* (2006.01)

(52) U.S. Cl.
CPC ..... *B65D 81/075* (2013.01)

(58) Field of Classification Search
CPC ..... B65D 81/075; B65D 81/07; B65D 81/05
USPC ..... 206/583, 521, 586
See application file for complete search history.

(56) References Cited

U.S. PATENT DOCUMENTS

| | | | | |
|---|---|---|---|---|
| 26,685 | A | | 2/1897 | Smith |
| 2,993,587 | A | | 7/1961 | Stone et al. |
| 3,027,062 | A | | 4/1962 | Huss |
| D198,513 | S | | 6/1964 | Caprioli |
| D214,487 | S | | 6/1969 | Reichl |
| 3,521,743 | A | | 7/1970 | Sposito, Jr. |
| 3,853,220 | A | * | 12/1974 | Luray ..... 206/466 |
| 4,470,538 | A | | 9/1984 | Heathcock et al. |
| 4,606,460 | A | | 8/1986 | Luray |
| 4,852,743 | A | | 8/1989 | Ridgeway |
| 4,865,200 | A | | 9/1989 | Sullivan et al. |
| 5,153,402 | A | | 10/1992 | Quick et al. |
| 5,218,510 | A | | 6/1993 | Bradford |
| 5,251,760 | A | | 10/1993 | Smith |
| 5,323,896 | A | | 6/1994 | Jones |
| 5,388,701 | A | | 2/1995 | Ridgeway |

(Continued)

FOREIGN PATENT DOCUMENTS

EP 0403514 B1 1/1994

*Primary Examiner* — Steven A. Reynolds
(74) *Attorney, Agent, or Firm* — Malloy & Maloy, P.L.

(57) ABSTRACT

A packaging assembly structured to suspend an article within an exterior container and including first and second platforms each having a base with a window extending therethrough and a plurality of side portions extending about the periphery thereof. The side portions are movable into a transverse orientation relative to their respective bases. Connected to the first platform is at least one flexible material bag, which includes an access opening to receive an article. Peripheral portions of the bag connect to side portions of the first platform and are movable therewith into a transverse orientation, facilitating tensioning of the bag and article. Disposition of the second platform in an inverted, retaining position within the exterior container and in confronting relation to the first platform furthers tension of the bag and article. Stabilizing members may be connected to side portions of the exterior container and disposable there within, restricting the article's movement.

12 Claims, 21 Drawing Sheets

(56) References Cited

U.S. PATENT DOCUMENTS

| | | | | |
|---|---|---|---|---|
| 5,405,000 | A * | 4/1995 | Hagedon et al. | 206/216 |
| 5,678,695 | A | 10/1997 | Ridgeway et al. | |
| 5,722,541 | A | 3/1998 | Lofgren et al. | |
| 5,741,535 | A | 4/1998 | Cope et al. | |
| 5,762,200 | A | 6/1998 | Goudreau | |
| 5,894,932 | A | 4/1999 | Harding et al. | |
| 5,901,852 | A | 5/1999 | Simpson | |
| 5,967,327 | A | 10/1999 | Jones | |
| 5,975,307 | A | 11/1999 | Harding et al. | |
| 6,006,917 | A | 12/1999 | Loeffler | |
| 6,073,761 | A | 6/2000 | Jones | |
| 6,158,589 | A | 12/2000 | Smith et al. | |
| 6,223,901 | B1 | 5/2001 | Lofgren et al. | |
| 6,289,655 | B1 | 9/2001 | Ridgeway et al. | |
| 6,302,274 | B1 | 10/2001 | Ridgeway | |
| 6,311,843 | B1 | 11/2001 | Smith et al. | |
| 6,675,973 | B1 | 1/2004 | McDonald et al. | |
| 6,685,025 | B1 | 2/2004 | Kari | |
| 7,085,534 | B2 | 8/2006 | Bentley | |
| 7,290,062 | B2 | 10/2007 | Henrion | |
| 7,290,662 | B2 | 11/2007 | Lofgren et al. | |
| 7,743,924 | B2 | 6/2010 | McDonald et al. | |
| 7,882,956 | B2 | 2/2011 | McDonald et al. | |
| D667,305 | S | 9/2012 | Kuhn et al. | |
| 8,727,123 | B1 | 5/2014 | Roberts | |
| D706,136 | S | 6/2014 | Roberts | |
| 2001/0047950 | A1 | 12/2001 | Beneroff et al. | |
| 2008/0029419 | A1 | 2/2008 | Appelbaum | |
| 2009/0272667 | A1 | 11/2009 | McDonald et al. | |

* cited by examiner

SUSPENSION PACKAGING ASSEMBLY

CLAIM OF PRIORITY

The present application is a continuation-in-part application of previously filed, U.S. Pat. No. 8,727,123, issued on May 20, 2014 and having a filing date of Mar. 3, 2012, which claims priority under 35 U.S.C. §119(e) to provisional patent application having Ser. No. 61/464,889 and a filing date of Mar. 11, 2011, and which are all incorporated herein by reference.

BACKGROUND OF THE INVENTION

1. Field of the Invention

This invention relates to a packaging assembly structured to suspend an article within an exterior container in spaced relation to the interior surfaces or wall portions thereof. In accomplishing a protective suspension of the article, the packaging assembly includes a first and second platform cooperatively dimensioned, configured and structured to suspend any one of a plurality of articles within the interior of a flexible material bag, wherein tensioning forces may be applied to the bag and the enclosed article by cooperative placement of the first or second platforms and the structural components associated therewith.

2. Description of the Related Art

Different packaging structures and assemblies are well known and commonly utilized throughout the shipping, storing and related industries. As such, the various conventional and customized packaging assemblies include use of various types of materials. Perhaps most typically such materials include some type of outer shipping or containment container made of a rigid or other appropriate durable material. In addition, the outer container is structured to house other smaller containers and/or interior padding or cushioning components disposed in a protecting relation to the article or articles being stored, shipped or otherwise contained. Similarly, the cushioning or padding components may be formed from a variety of materials such as foam or other force absorbing materials.

Further, it is well known to shape, dimension and otherwise structure foam-like cushioning components to accommodate the specific mention and configuration of the article being contained. Aside from the exterior container itself, additional structures are ordinarily needed, in the form of the aforementioned padding or cushioning members to prevent the article being damaged. This is especially true in situations where the contained or packaged article or articles undergo extensive movement, such as in the transfer to various delivery or shipping carriers.

One form of known packaging systems is generally referred to as "retention" packaging. When applied, this version of packaging includes a frame including a rigid border extending around a periphery and including various supporting components. One or more articles are enclosed within a film type structure, wherein plurality of overlapping structures border the enclosed article or are folded there over in a protective relation.

Therefore in many of the most commonly used packaging systems additional structural components are used to keep the article from moving or shifting within the exterior shipping container. As should be obvious, this is done to avoiding damaging the contained article. Naturally, the overall size and physical characteristics of the contained article are taken into serious consideration. Fragile articles such as glass or other breakable materials are treated with greater care, frequently resulting in more expensive and/or customized containers and the like. Also, when dealing with electronic devices, it is frequently necessary to protect the contained article from exposure to dust, dirt, moisture or any other ambient conditions which could render the shipped article useless or severely damaged.

Another packaging system and method is generally referred to as "suspension" packaging. In typical fashion, such type of packaging may comprise a frame and a product restraining structure associated therewith wherein the ends of the frame or other components associated therewith are disposed in supporting relation to the contained article. It is commonly recognized that the suspension packaging is well suited for a variety of applications, such as transportation and the like, specifically when the contained article is formed of a fragile material, as set forth above. However, problems and disadvantages associated with suspension packaging, as well as other packaging systems are well recognized in the related industries. As a result, the aforementioned customized packaging is frequently required wherein additional costs in the shipping, containing, storing, etc. of various types of articles are problematic.

Therefore, there is a recognized need in the packaging industry for an improved packaging assembly and/or system which overcome many of the disadvantages and problems of conventional or known packaging structures. Such an improved packaging assembly should demonstrate sufficient versatility to be used the protectively package and/or contain different articles, which may vary in size, shape, weight and number.

SUMMARY OF THE INVENTION

The present invention is directed to a packaging assembly structured to protectively package various articles which may vary in size, dimension, weight, etc. More specifically, the packaging assembly of the present invention is disposable within an exterior container in a manner which maintains at least one enclosed article in a suspended orientation.

As such, the packaging assembly of the present invention includes a first and second platform which, in at least one embodiment, may have substantially equivalent dimensions, configurations and overall structures. The first and second platforms each include a base having at least one window extending therethrough, as well as a plurality of side portions extending about the periphery of the respective bases. Each of the side portions of each of the platforms are independently disposable in a transverse orientation to the base, wherein the side portions of either of the platforms may be directed in a same or opposite direction when transversely oriented.

The packaging assembly also includes a flexible material bag made from a plastic or other appropriate material having a certain degree of flexibility and/or resiliency, such that a retaining and protective "tension" can be exerted thereon in order to better facilitate maintenance of the suspension of the bag when disposed within the exterior container. Accordingly, the bag and the first platform are cooperatively dimensioned and structured to enclose the article within the bag as it is passed through an access opening. When enclosed, the article is disposed in substantially aligned relation to the window of at least the first platform.

The above noted "tensioning" of the article and the bag are partially accomplished by the fixed or removable connection or attachment of peripheral portions of the bag to corresponding ones of the side portions of the first platform. Therefore, when the side portions of the first platform are disposed in the transverse orientation, the attached peripheral portions of the bag move with the corresponding side portions. This forced movement of the peripheral portions of the bag serves to exert a "stretching" force on the bag thereby serving to tension the bag and concurrently tension or exert a force on the enclosed article. This "tensioning" facilitates the retention of the article and also serves to maintain the bag in spaced relation to the peripheral portions of the bag and in a substantially centered location within the window of the first platform.

The assembly of the suspended packaging assembly also includes the disposition of the second platform in an inverted, retaining position relative to the first platform. The retaining position of the second platform, relative to the first platform, is more specifically defined as disposing the bases of the first and second platforms in substantially confronting relation to one another. When in such confronting relation, the flexible material bag is disposed in sandwiched relation between the confronting bases. The retaining position of the second platform may be further defined as comprising the windows of the first and second platform being disposed in aligned relation to one another such that article enclosed within the bag is also aligned with the windows and thereby substantially or at least partially centered relative to both of the aligned windows.

As used herein, the term "centered" at least to the extent of describing the relative positions of the enclosed article and aligned windows is not meant to describe a precise centered location of the article. In contrast, the "centered" position of the closed article is more generally defined as being spaced from the periphery of the aligned windows and further disposed in a suspended, spaced relation from any portion of the confronting bases. In addition and for purposes of clarity, the term "confronting relation" is used to describe the bases of the first and second platforms when in the retaining position, recognizing that the flexible material bag is "sandwiched" therebetween. Accordingly, the confronting relation of the bases is not necessarily meant to define the confronting "engagement" of the bases, as will be further described hereinafter with regard to the accompanying drawings.

As set forth above, one feature of the present invention includes the ability to apply a sufficient and/or adequate amount of tension to the bag as well as the article enclosed therein. This is accomplished, at least in part, by the connection of the peripheral portions of the bag to the side portions of the first platform which extend about the periphery of the base thereof. Therefore, when the side portions are moved into the transverse orientation, the peripheral portions of the bag will move with the corresponding side portions, resulting in a stretching or tensioning force being exerted on the bag. The enclosed article will also thereby be effectively "clamped" between the sidewalls of the bag serving to retain it in a centered orientation between the aligned windows, as set forth above. Further, the disposition of the second platform in the inverted, retaining position will also serve to add to the "tensioning" forces exerted on the bag and the enclosed article. This is due to the effect that the bases of the first and second platform are effectively "clamped" into the aforementioned confronting relation to one another thereby having a tendency to tension or at least minimally stretch the flexible material surrounding the enclosed article.

Structural modifications or features associated with the additional preferred embodiments of the present invention include the peripheral portions of the bag being attached or connected to corresponding side portions of the first platform by a variety of connecting facilities. Such may include the adhesive attachment, stapling, or the use of a variety of other appropriate connectors. However, one additional structural modification of at least the first platform and possibly both the first and second platforms, include the formation of at least one but possibly a plurality of locking tabs. When used, the locking tabs extend about the outer periphery of each of the side portions of the platforms. In cooperation therewith, the bag may include at least one but possibly a plurality of slots extending about the periphery thereof. Each of the slots is disposed in communicating relation with a corresponding one of the locking tabs. As a result, the dimension and configuration of corresponding slots and locking tabs are such as to facilitate an interlocking but removable connection therebetween. This serves to removably but securely connect, attach, etc. the peripheral portions of the bag to the side portions of the first platform and the peripheral portions of the bag being movable with the side portions, as they are disposed in the aforementioned transverse orientation.

Similarly, the closing of the access opening of the bag may also be accomplished by one or more slots being formed in the periphery or other portion of the bag adjacent the access opening. The one or more slots formed adjacent the access opening are correspondingly positioned, dimensioned, etc. to the one or more locking tabs formed in the periphery of the side portion corresponding to the access opening. Therefore, the aforementioned slots and locking tabs are cooperatively structured to interlock or interconnect with one another to facilitate a closing of the access opening after the article is placed in the bag through the access opening. Also, the peripheral portion of the bag associated with the access opening moves with the corresponding side portion into the aforementioned transverse orientation thereby further facilitating a tensioning force being exerted on the bag and enclosed article.

Yet additional preferred embodiments of the packaging assembly of the present invention include the each base of the first and second platforms comprising a plurality of windows disposed in spaced relation to one another. In such a structural modification the modified packaging assembly is able to concurrently package, in a suspended manner, a plurality of articles. Moreover, a plurality of flexible material bags will be disposed in connected relation to the base of the first platform and in overlying, substantially aligned relation to different one of the plurality of windows formed therein. Similarly, when the second platform is disposed in the inverted, retaining position the plurality of windows therein will be aligned with the plurality of windows in the base of the first platform. As a result, the aforementioned tensioning and/or stretching forces will be exerted on the plurality of flexible material bags further facilitating the suspension of the enclosed article in the respective bags.

Finally, the various embodiments of the present packaging assembly of the present invention can be formed and utilized to assume a number of different sizes. Also, the dimensions and resulting configuration thereof may vary greatly from the proportions thereof as represented in the accompanying drawings. By way of example only, both the length and width of the first and second platforms, as well as the bag, may be increased or decreased so as to accommodate the size of any of a number of different articles being packaged.

In addition, the material of the bag may also vary to accommodate the type and/or particular "needs" of the article being packaged. More specifically, when packaging electronic articles, an anti-static plastic material may be used in the formation of the bag. Also, material commonly known as "bubble wrap" may be used to provide added cushioning or protection, such as to more fragile articles.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

As represented in the accompanying Figures, the present invention is directed to a packaging assembly structured to support one or more articles within an exterior container.

Figure 1:
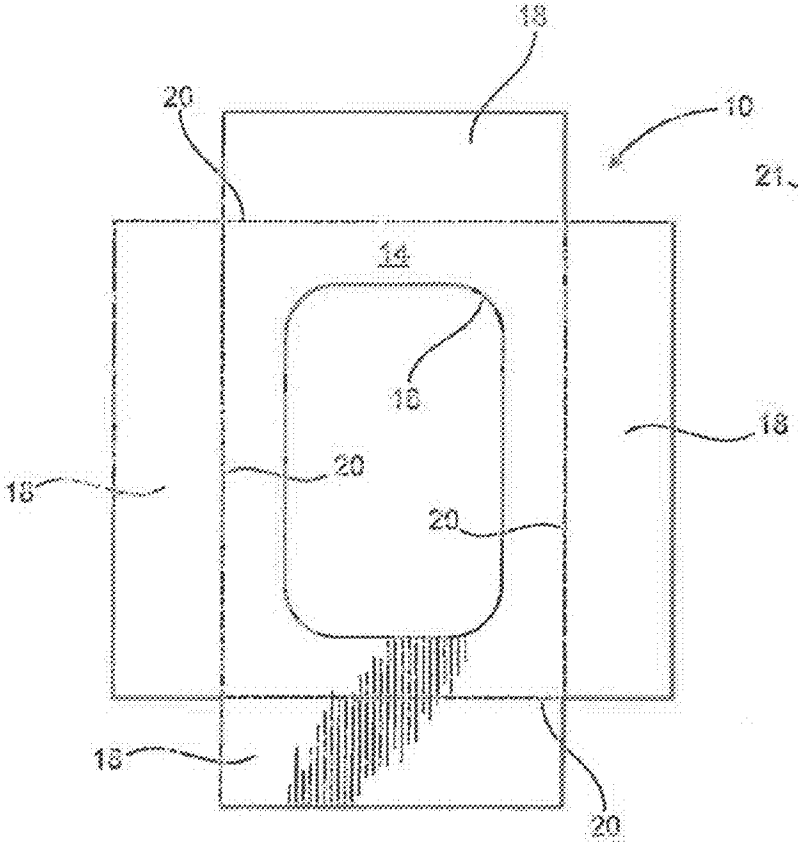
FIG. 1 is a top plan view of a first platform of the packaging assembly of the present invention.
Figure 2:
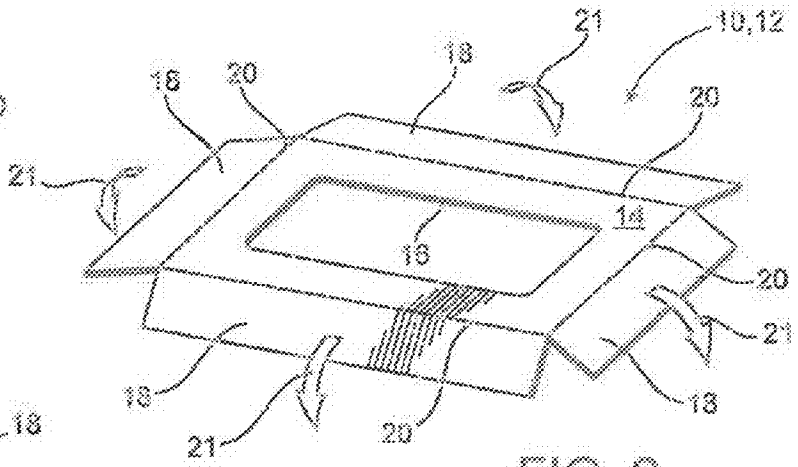
FIG. 2 is a top perspective view of the embodiment of FIG. 1, wherein peripheral side portions thereof are disposable in a transverse orientation.
Figure 3:
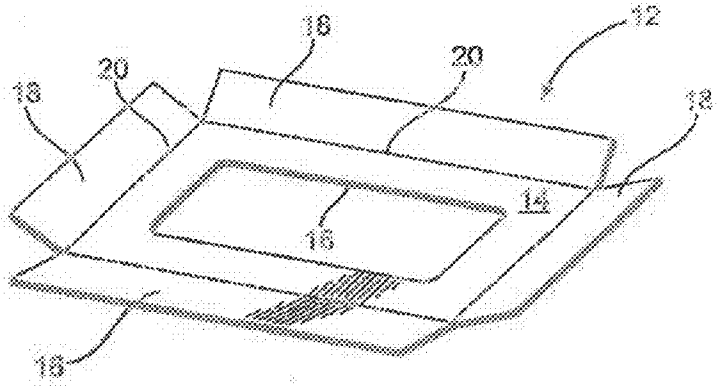
FIG. 3 is a bottom perspective view of a second platform of the packaging assembly of the present invention.

More specifically, the packaging assembly comprises a first platform generally indicated as 10 and a second platform generally indicated as 12. Each of the first and second platforms 10 and 12 include a base 14 and a central or otherwise appropriately disposed window 16 formed in and extending through the base. In addition, the first platform 10 includes a plurality of side portions 18 extending about the periphery thereof, wherein each of the side portions 18 are movable, independent of one another about a score line, crease, fold line, etc. 20 into a transverse or other appropriate orientation relative to the base 14. Similarly, in at least one preferred embodiment, the second platform 12 may be substantially equivalently dimensioned, configured and structured and thereby include a plurality of side portions 18', each movable independently of one another about the aforementioned creases, fold lines, 20. As represented in FIG. 2, the independent movement of the side portions 18 and 18' of each of the first and second platforms facilitates their selective positioning into a substantially transverse orientation relative to the base 14, as schematically represented by directional arrows 21 and as will be described in greater detail hereinafter.

Figure 26:
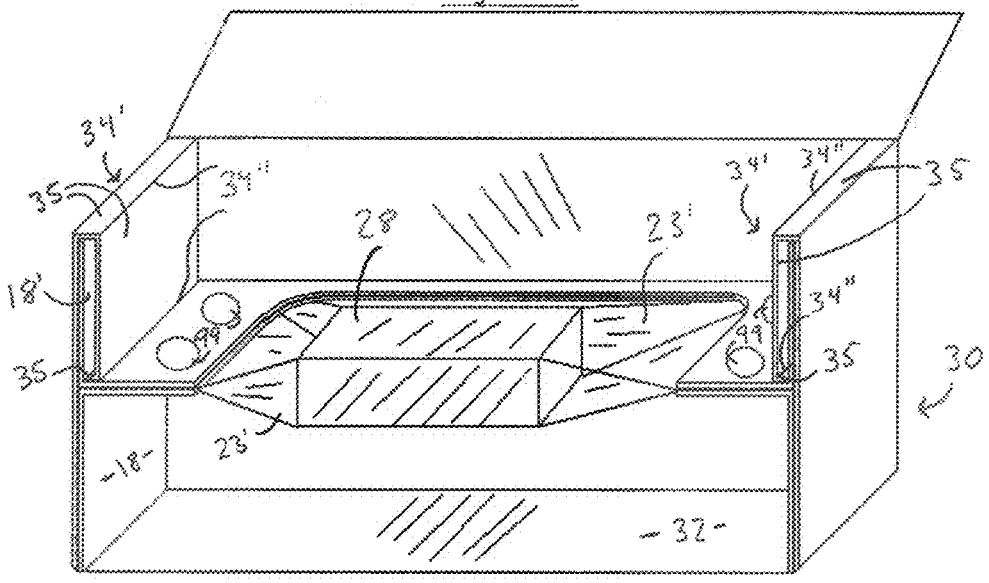
FIG. 26 is an interior sectional view, in perspective, of another embodiment of the present invention wherein the first and second platforms are disposed within the interior of an exterior container in the retaining position.

Additionally, the second platform 12 may comprise indicia, indicated at 99 in FIG. 26. The indicia 99 are not limited to the embodiment as depicted in FIG. 26, but rather the second platform 12 may comprise the indicia 99 in any such embodiment of the present invention that comprises a second platform 12. Consequently, the inclusion of indicia 99 in the embodiment of FIG. 26 is merely an illustrative example and is not intended to so limit the presence of indicia 99 to any one shown embodiment. The indicia 99 may be affixed to the second platform 12, such as by first printing the indicia on a sheet that has an adhesive backing and then placing the sheet on the second platform 12. Alternatively, the indicia 99 may be printed upon the second platform 12, such as with ink. The second platform 12 is appropriately structured for the presentation of the indicia 99. In any case, indicia 99 may be aesthetic or decorative. Alternatively or additionally, the indicia 99 may be related to or otherwise correspond to the nature of the enclosed article 28. As an illustrative example, the indicia 99 may be a pictorial or graphic representation of a bunch of grapes if the enclosed article 28 is a bottle of wine. Alternatively or additionally, the indicia 99 may be structured to comprise directions or instructions corresponding to use of the enclosed article 28.

Figure 5:
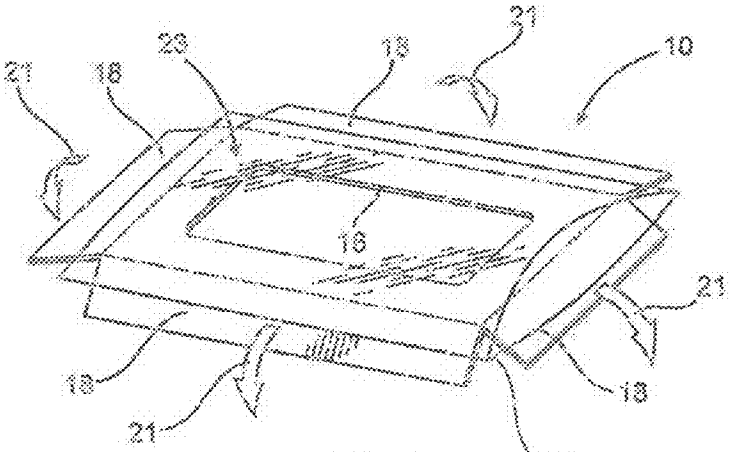
FIG. 5 is a perspective view of the embodiment of FIG. 4.
Figure 4:
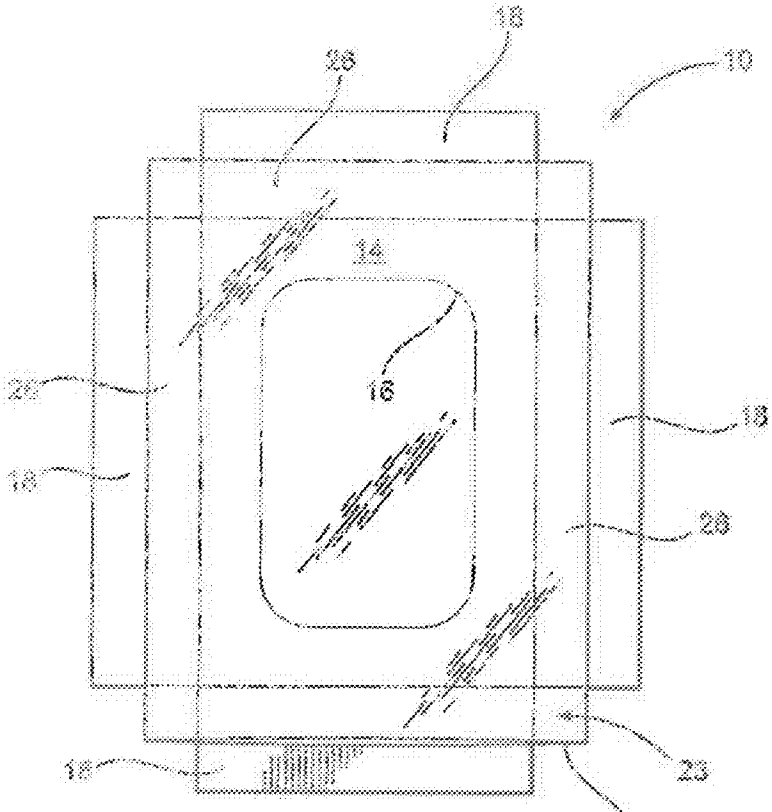
FIG. 4 is a top plan view of a flexible material bag connected to the first platform of the embodiment of FIG. 1.
Figure 6:
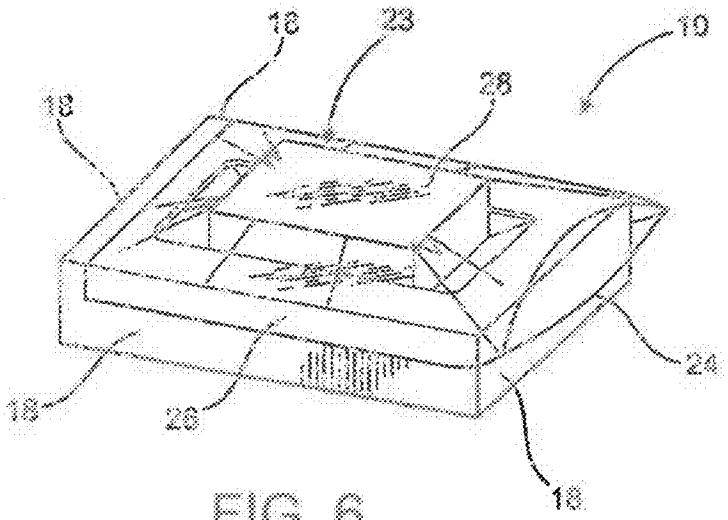
FIG. 6 is a perspective view of the embodiments of FIGS. 4 and 5.

With primary reference to FIGS. 4-6, the various preferred embodiments of the packaging assembly of the present invention further includes a flexible material bag 23 having an access opening 24 formed along one periphery thereof. The remaining peripheral portions 26 of the bag 23 are sealed or closed along the edge thereof. The peripheral edge of the bag 23 associated with the access opening 24 initially remains open for the passage of any of a plurality of articles (See FIGS. 6 and 7) into an enclosed relation on the interior of the bag 23. The bag 23 may be formed from any of a variety of different plastic or other appropriate materials which include at least a minimal amount of flexibility or resiliency such that "tensioning" or "stretching" forces can be exerted thereon in the manner described hereinafter.

It is emphasized that as used herein, the term "bag" is meant to include any appropriately dimensioned and configured pouch or other at least minimally flexible container capable of being disposed and/or attached to the first and second platforms 12 and 14 and positioned therewith within the exterior container, as described in greater detail herein.

More specifically, in the embodiment of FIGS. 1-9, the peripheral portions 26 of the bag 23 are fixedly attached to corresponding side portions 18 of the first platform 10. Cooperative structuring and dimensioning of the first platform 10 with the bag 23 facilitates at least a portion of the center of the bag being disposed in overlying, substantially aligned relation with the window 16 formed in the base 14 of the first platform. As set forth above, and as schematically represented in FIG. 5, when the flexible bag 23 is attached to the first platform 10, the side portions 18 thereof may be folded or moved into a transverse orientation and more specifically in a direction indicated schematically by the directional arrows 21.

Figure 7:
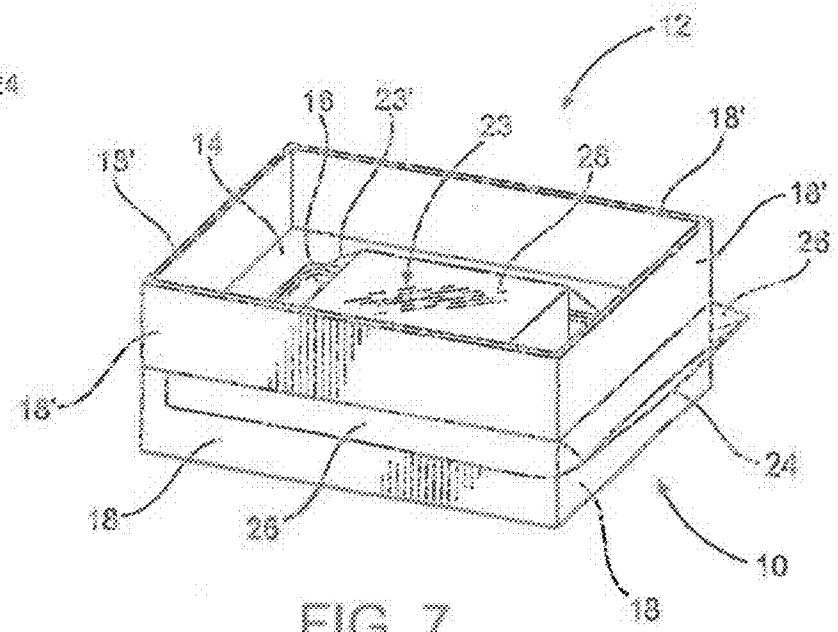
FIG. 7 is a perspective view of the first and second platforms in a retaining position.

This concurrent movement of the side portions 18 and the connected or attached peripheral portions 26 will serve to exert a tension on the bag as well as an article 28 enclosed therein by being passed through the access opening 24. Therefore, when the side portions 18 of the first platform 10 are disposed in the preferred transverse orientation as represented in FIGS. 6 and 7, a sufficient tension and/or stretching force will be exerted on at least the center portions of the bag 23 so as to serve to retain and further tension the enclosed article 28 in its intended location in aligned relation to the corresponding window 16, as clearly represented in FIG. 6. The article 28 may pass through the access opening 24 and thereby be enclosed within the bag 23 in an intended location prior to the disposition of the side portions 18 in the transverse orientation, as represented in FIG. 6.

FIG. 7 represents another step in the formation or assembly of the packaging assembly to the extent that the second platform 12 is disposed in an inverted, restraining position relative to the first platform 10. When in this inverted, restraining position, the second platform includes the base 14 thereof disposed in confronting relation to the base 14 of the first platform 10. Such confronting relation between the bases 14, 14 of the first and second platforms 10 and 12 may also be defined by the bag 23 being disposed in sandwiched relation between the confronting bases 14, 14. The inverted, retaining position of the second platform 12, relative to the first platform 10 may be further defined by the corresponding windows 16 being aligned with one another. Further, the enclosed article 28 and the adjacent, surrounding portions 23' of the bag 23 are aligned with and possibly protrude through both the windows 16. Moreover, the confronting relation of the bases 16, 16 of the first and second platforms 10 and 12 further serves to enhance the tension or stretching force being exerted at least of the portions of the bag 23' disposed in adjacent, surrounding relation to the article 28.

Figure 8:
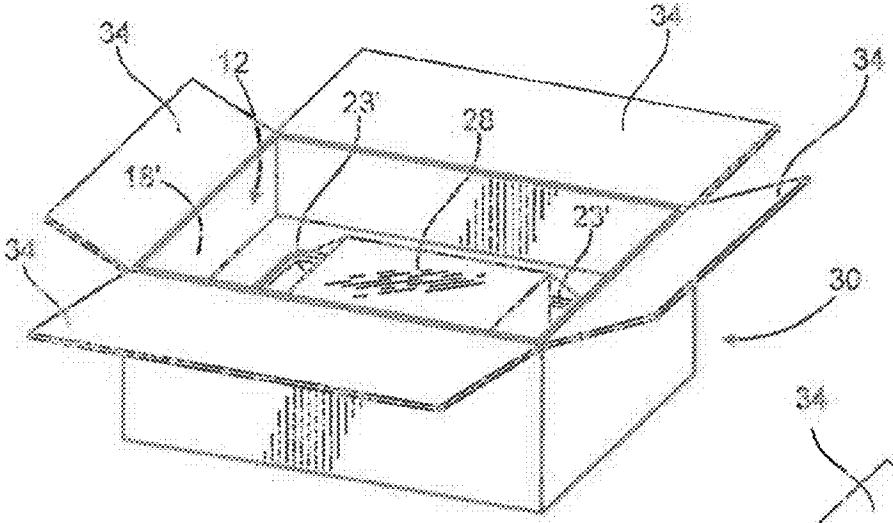
FIG. 8 is a perspective view of the embodiment of FIG. 7 wherein the first and second platforms are disposed within the interior of an exterior container in the retaining position of FIG. 7.
Figure 9:
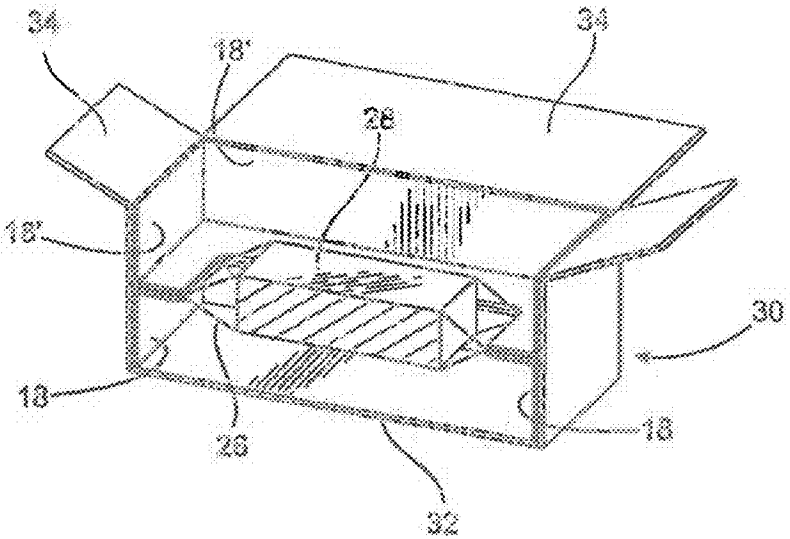
FIG. 9 is an interior sectional view, in perspective of the embodiment of FIG. 8.

With primary reference to FIGS. 8 and 9, additional features of the packaging assembly of the present invention include both the first platform 10 and the second platform 12 being disposed within an exterior container 30. While disposed therein, the second platform 12 may be disposed in the inverted, retaining position relative to the first platform 10, while the article 28 is enclosed within the bag 23. FIG. 9 represents an interior view of the first and second platforms 10 and 12 on the interior of the container 30, concurrent to the second platform 12 being in the aforementioned inverted, retaining position. When so disposed, the transversely oriented side portions 18 and 18' extend outwardly from the respective bases 14 in opposite directions. As such, the side portions 18 and 18' respectively extend towards opposite ends or enclosing portions 32 and 34 of the exterior container 30.

As such, the transversely oriented side portions 18 and 18' of the first and second platforms 10 and 12 may collectively act or serve as "shock absorbers." Due to the fact that the enclosed article 28 will be suspended in aligned relation with the respective windows 16, it will be maintained in spaced relation to both of the bases 14 as well as the interior sidewall portions of the exterior container 30. As a result, any trauma, pressure or like forces inadvertently exerted on the exterior container 30 will not be absorbed directly by the enclosed article 28. Instead, such forces will be at least partially absorbed by the transversely oriented side portions 18 and/or 18', dependent on the orientation of the exterior container 30.

Figure 11:
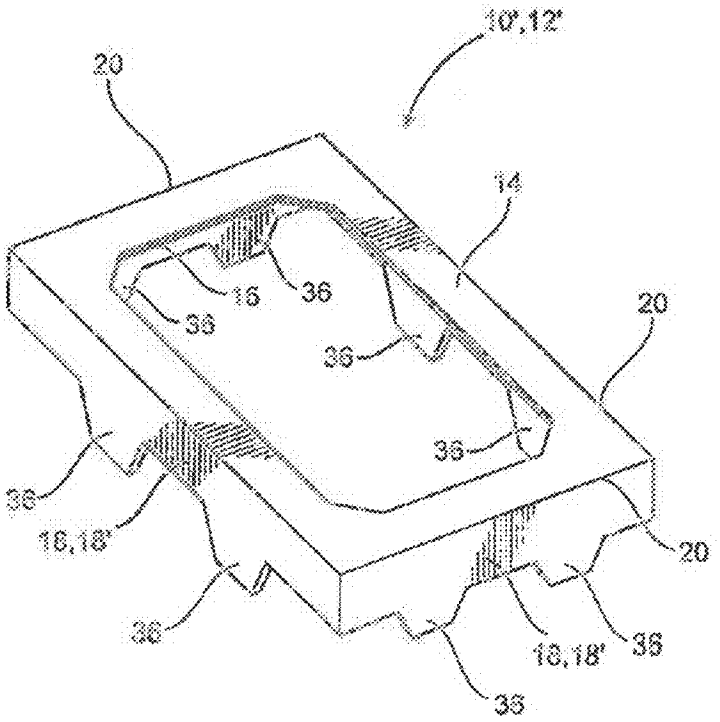
FIG. 11 is a perspective view of the first platform wherein the peripheral side portions thereof are disposed in a transverse orientation.
Figure 10:
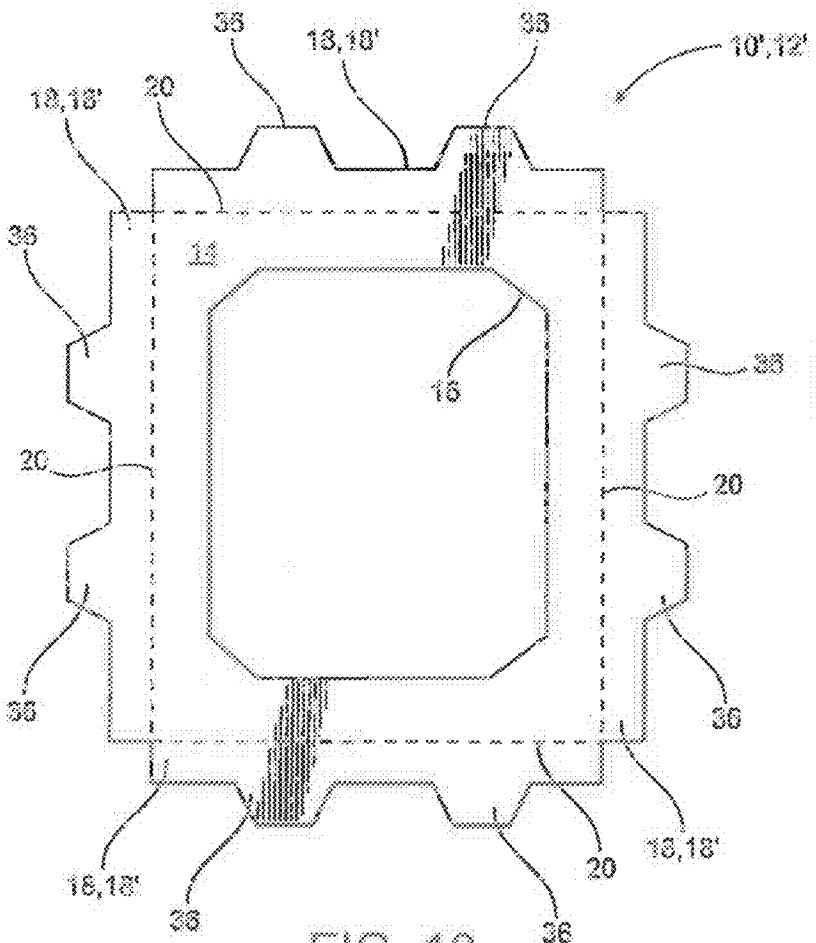
FIG. 10 is a top plan view of another embodiment of both the first and second platforms.

Yet another preferred embodiment of the present invention is represented in FIGS. 10-15. More specifically, the packaging assembly in this embodiment includes both a first and second platforms 10' and 12' respectively having substantially equivalent dimensions, configurations and overall structures. Therefore, both the first and second platforms 10' and 12' include a base 14, window 16 formed to extend therethrough and side portions 18 and 18'. Moreover, the side portions 18 and 18' are disposable into a transverse orientation, as represented in FIG. 11, as they are folded about creases, score lines, fold lines, etc. 20.

However, the structural modifications associated with the embodiment of FIGS. 10-15 include at least one, but in certain practical applications, a plurality of locking tabs 36 formed on and/or connected to and extending outwardly from the outer periphery of at least the side portions 18 of the first platform 10'. However, in order to facilitate the production of both the first and second platforms, their substantially equivalent dimensions, configurations and overall structures may best facilitate the formation of the one or more locking tabs on the side portions 18 and 18' of both the first and second platforms 10' and 12'.

Figure 13:
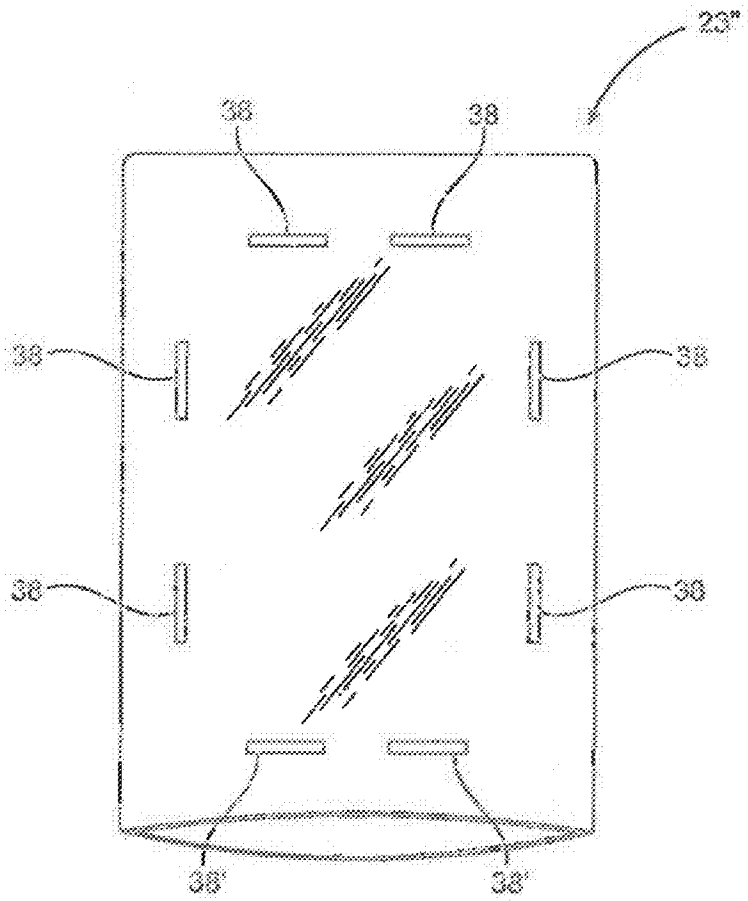
FIG. 13 is a perspective view of another preferred embodiment of the flexible bag structured to accommodate structural modifications of the first and second platforms as represented in FIGS. 10 and 11.
Figure 12:
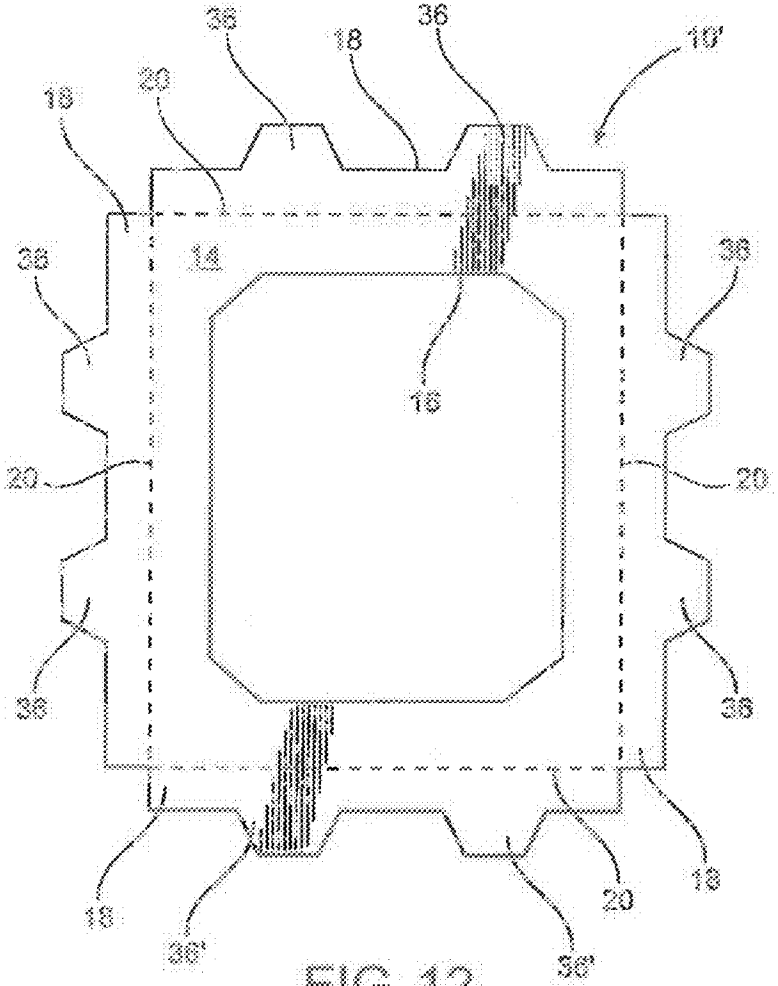
FIG. 12 is a top plan view of the embodiments of FIGS. 10 and 11.
Figure 14:
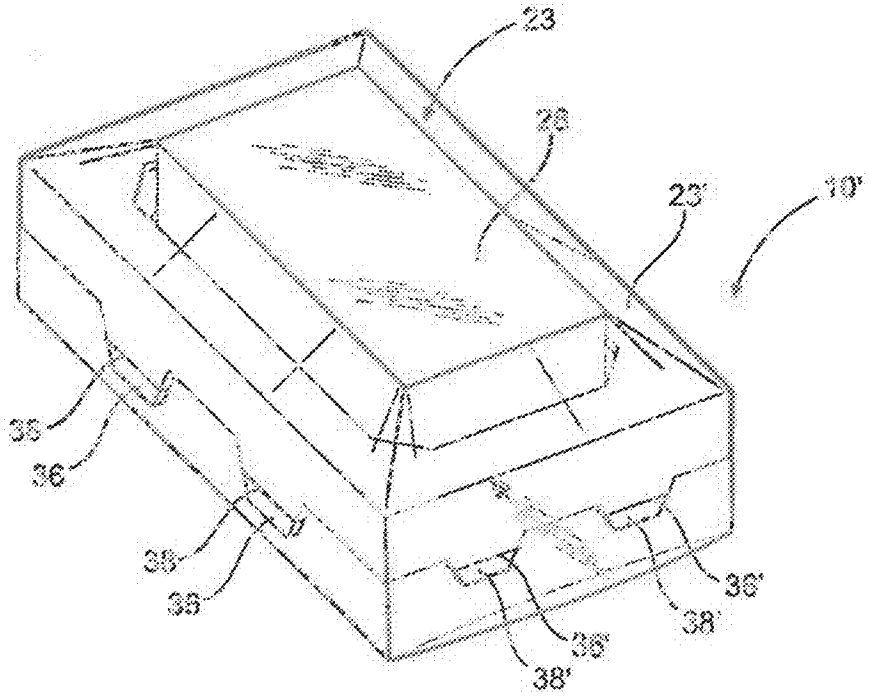
FIG. 14 is a perspective view of the first platform, bag and enclosed article in an at least partially assembled form.

With primary reference to FIGS. 12 and 13, another feature associated with the embodiment of FIGS. 10-15 include the flexible material bag 23' including a plurality of slots 38 formed therein generally about or adjacent to corresponding peripheral portions thereof, as well as in substantially adjacent relation to the access opening 24. Moreover, the one or more locking tabs 36 and the one or more slots 38 are correspondingly disposed on at least the first platform 10' and the flexible material bag 23'. In addition, each of the locking tabs 36 is correspondingly dimensioned and configured with a corresponding one of the slots 38 so as to extend there through. A removable but stable interconnecting or interlocking engagement there between is represented in FIG. 14. Therefore, the peripheral portions 26 of the bag 23" are connected to the corresponding side portions 18 of the first platform 10' and are movable therewith into the transverse orientation as represented in FIG. 14.

Similarly, the access opening 24 may be closed, after insertion of the article 28 into the interior of the bag 23' by interlocking or interconnecting engagement of correspondingly positioned tabs 36' with correspondingly disposed slots 38' formed in a portion of the bag 23' adjacent to the access opening 24.

Figure 27A:
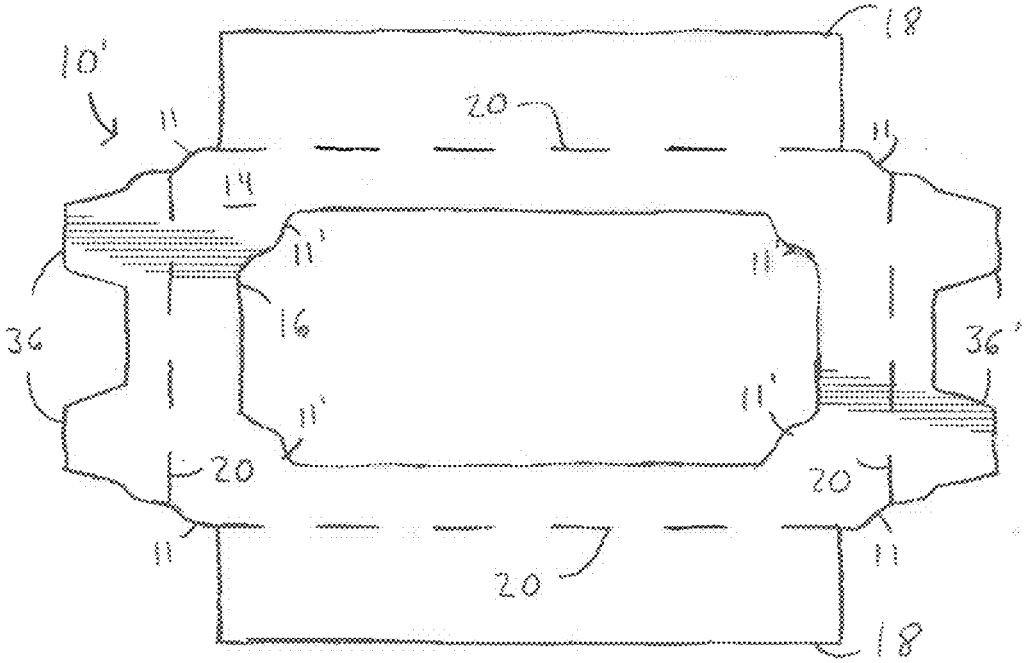
FIG. 27*a* is a top plan view of yet another embodiment of the first platform.
Figure 27B:
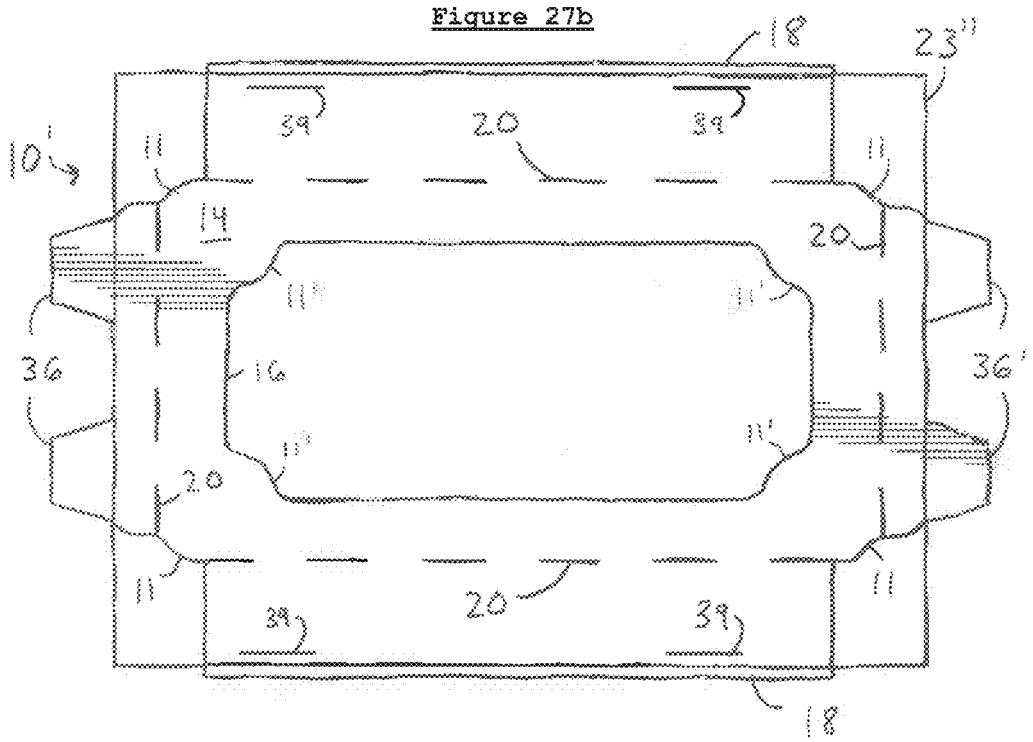
FIG. 27*b* is a top plan view of the embodiment of the first platform of FIG. 27*a* and a flexible bag.

Further, the first platform 10' may be structured as represented in FIG. 27*a*, and as shown in FIG. 27*b* with a bag 23" which may be secured to the first platform 10', such as by connectors 39. The first platform 10' therein may be "curved," i.e. employ curvilinear forms, on the inside corners of the base 14 of the first platform 10', indicated at 11'. The first platform 10' may be curved as indicated at 11 on the edge of the outside corners of the base 14. The curved shape of the corner edges 11 and 11' of the base 14 reinforces the structural integrity of the first platform 10' when it is facilitating the suspension of an article 28. The curves 11 11' may provide advantages when compared to non-curved corners, such as by resisting shear forces or withstanding the weight of the article 28 when it is suspended.

Figure 27C:
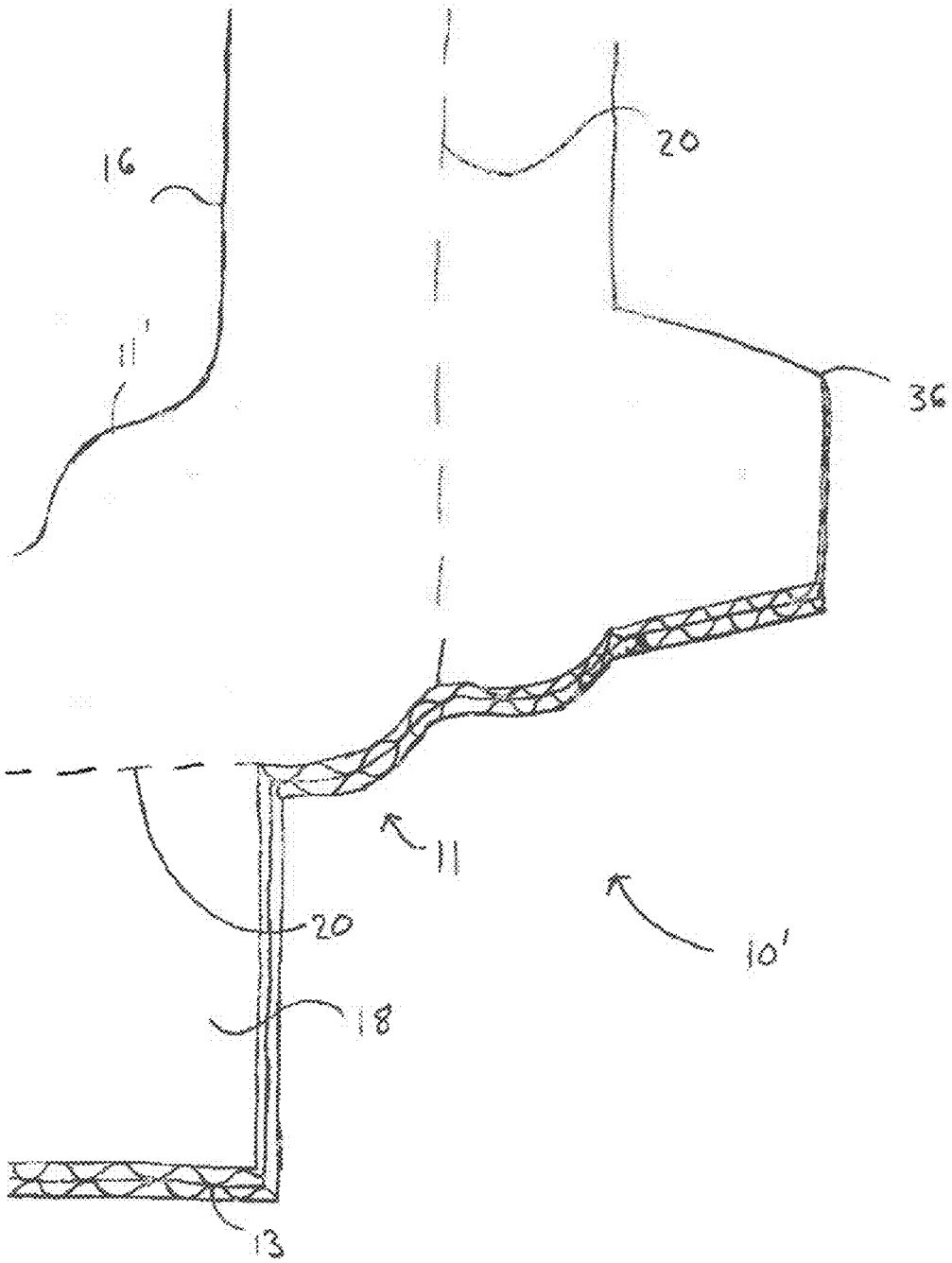
FIG. 27*c* is an enhanced perspective view in partial cutaway of the embodiment of FIG. 27*a*.

Additionally, with reference to FIG. 27*c*, the first platform 10' may be comprised of a corrugated material such as cardboard. The corrugations 13 may be aligned such that the "wave" pattern is distributed transversely across the length of the side portions 18

Figure 15:
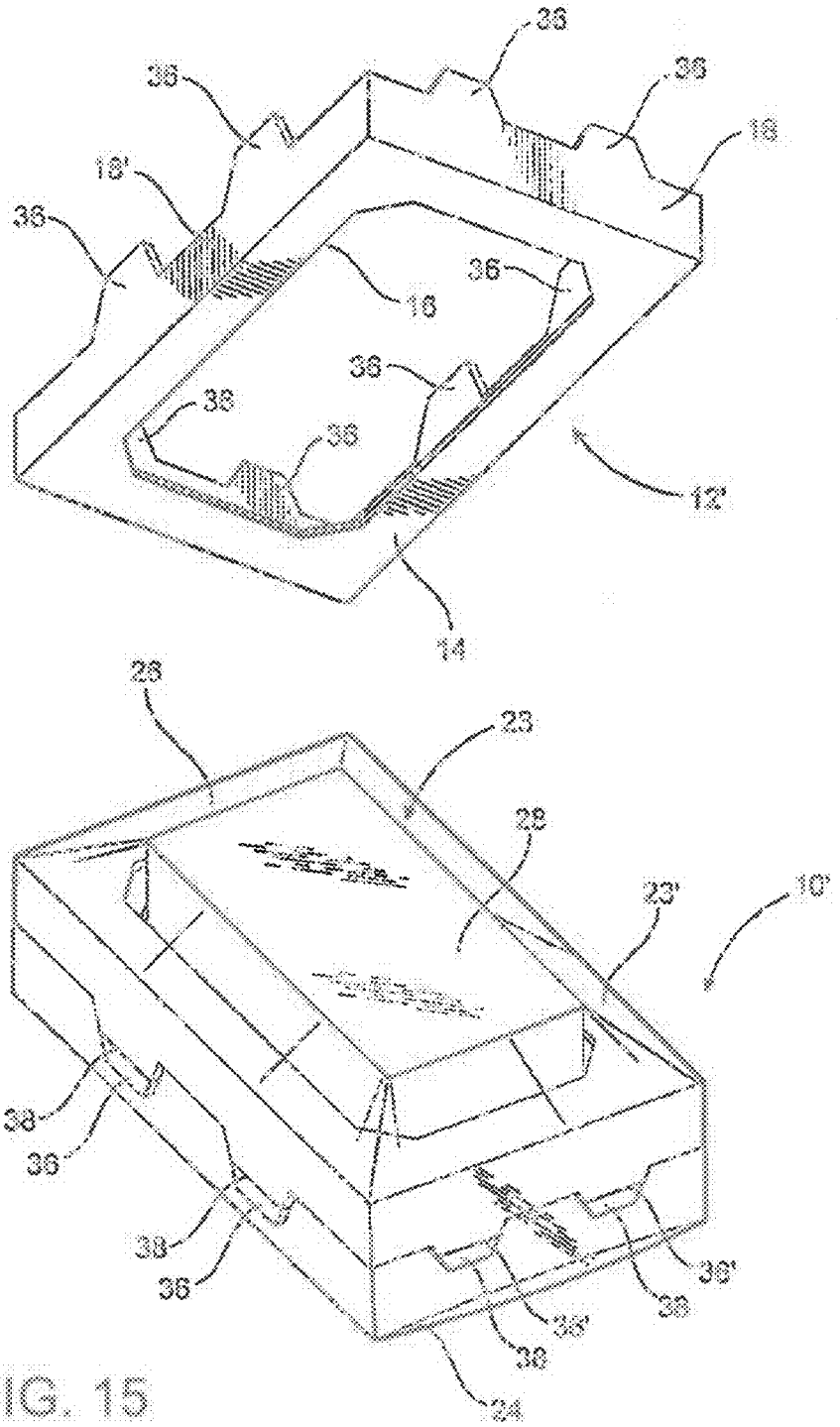
FIG. 15 is an exploded view of the first platform as represented in FIG. 14 and a second platform in a position facilitating a disposition thereof into a retaining position relative to the first platform.

Accordingly, as represented in FIGS. 14 and 15, this embodiment of the packaging assembly includes the positioning of the article 28 through the access opening 24 into the interior of the bag 23, such that it is aligned with the windows 16 of the first platform 10'. Either before or after such placement of the article 28, the one or more locking tabs 36 are disposed in interconnecting or interlocking relation with the correspondingly disposed one or more slots 38 as represented in FIGS. 14 and 15. The side portions 18 of the first platform 10' are disposed in the transverse orientation, as set forth above, which will exert a tensioning or stretching force on the bag 23 as well as the enclosed article 28.

As represented in FIG. 15, the second platform 12' may then be ready for disposition into the aforementioned inverted, retaining position, as described greater detail with the embodiment of FIGS. 7-9. The packaging assembly, specifically including the first and second platforms 10' and 12', will be maintained in the confronting relation to one another, as the second platform 12' is maintained in the retaining position, on the interior and exterior container 30 (See FIGS. 8 and 9).

Figure 17:
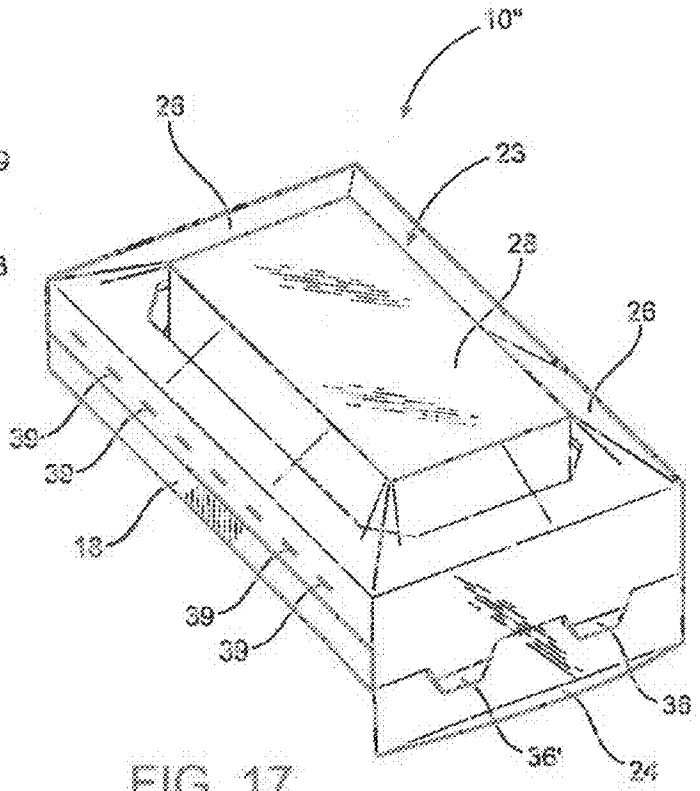
FIG. 17 is a perspective view of the embodiment of FIG. 16 in an at least partially assembled form and including an enclosed article.
Figure 16:
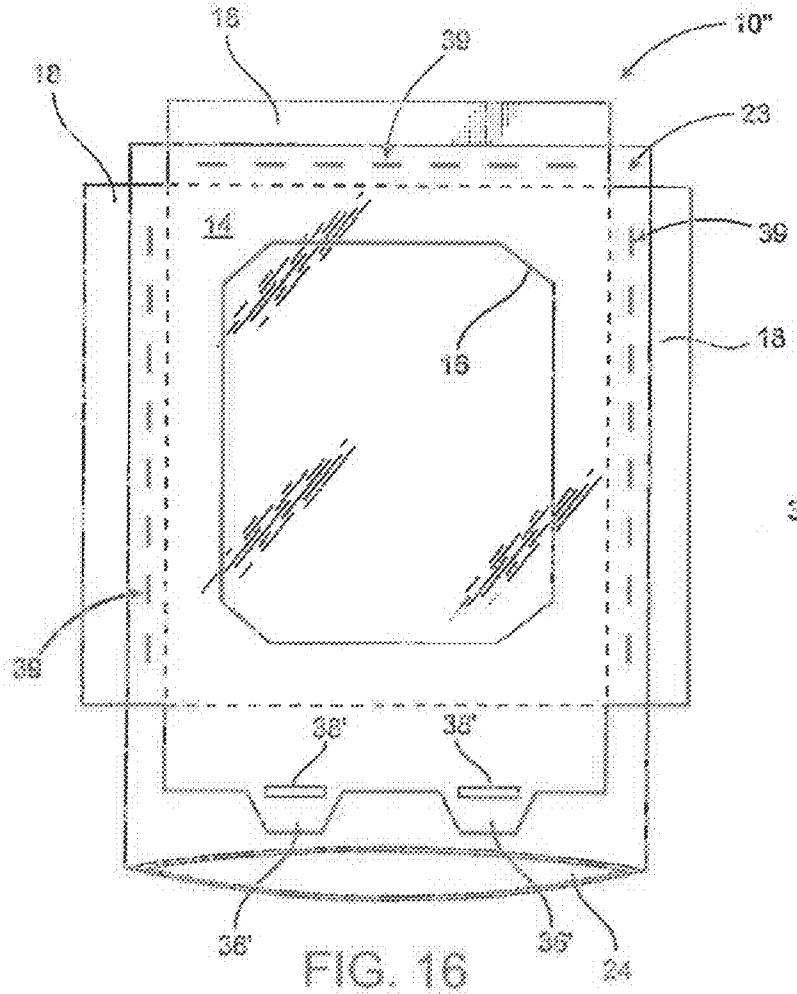
FIG. 16 is yet another preferred embodiment of both the first platform and the bag similar to but distinguishable from the embodiments of FIGS. 1-15.

Yet another preferred embodiment of the present invention is represented in FIGS. 16 and 17 and includes the structural and operative features of both the embodiments of FIGS. 1-9 and FIGS. 10-15. More specifically, the bag 23 is disposed in attached relation to the first platform 10" by connecting or securing the peripheral portions thereof to the correspondingly disposed side portions 18 of the first platform 10". Such attachment may be accomplished by adhesive or more practically by staples or similar connectors 39 passing both through the peripheral portions of the bag 23 and corresponding line portions of the side portions 18. However, in the embodiment of FIGS. 16 and 17 the access opening 24 is closed, subsequent to the positioning of the article 28 on the interior thereof, by means of at least one or more locking tabs 36'. As with the embodiment of FIGS. 10-15, the locking tabs 36' are formed on the side portion 18 which is correspondingly positioned relative to the access opening 24. In addition, one or more slots 38' are correspondingly dimensioned, configured and positioned so as to facilitate interconnection or interlocking engagement with corresponding ones of the locking tabs 36'. Such engagement between the locking tabs 36' and the slots 38' will serve to close the access opening 24 and allow the positioning of the corresponding end of the bag 23, associated with the access opening, to move with the corresponding side portion 18 into a transverse orientation. In such transverse orientation, additional tension or stretching forces will be exerted on the bag 23 while the access opening 24 will remain closed.

Figure 18:
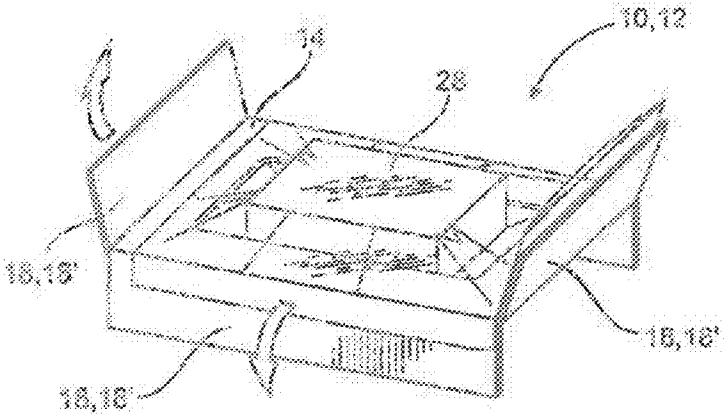
FIG. 18 is a perspective view of the embodiment of FIG. 17 wherein peripheral side portions of the first platform are disposed in different or opposite transverse orientations.

FIG. 18 is representative of all of the embodiments of FIGS. 1-17 and demonstrates that the side portions 18 or 18' of the first and second platforms 10 and 12 can be disposed in a transverse orientation relative to the corresponding base 14 in either of two opposite directions. This may facilitate a stable orientation or position of the first or second platforms within the exterior container 30 in order to further enhance the suspended stability of the enclosed article 28.

Figure 24:
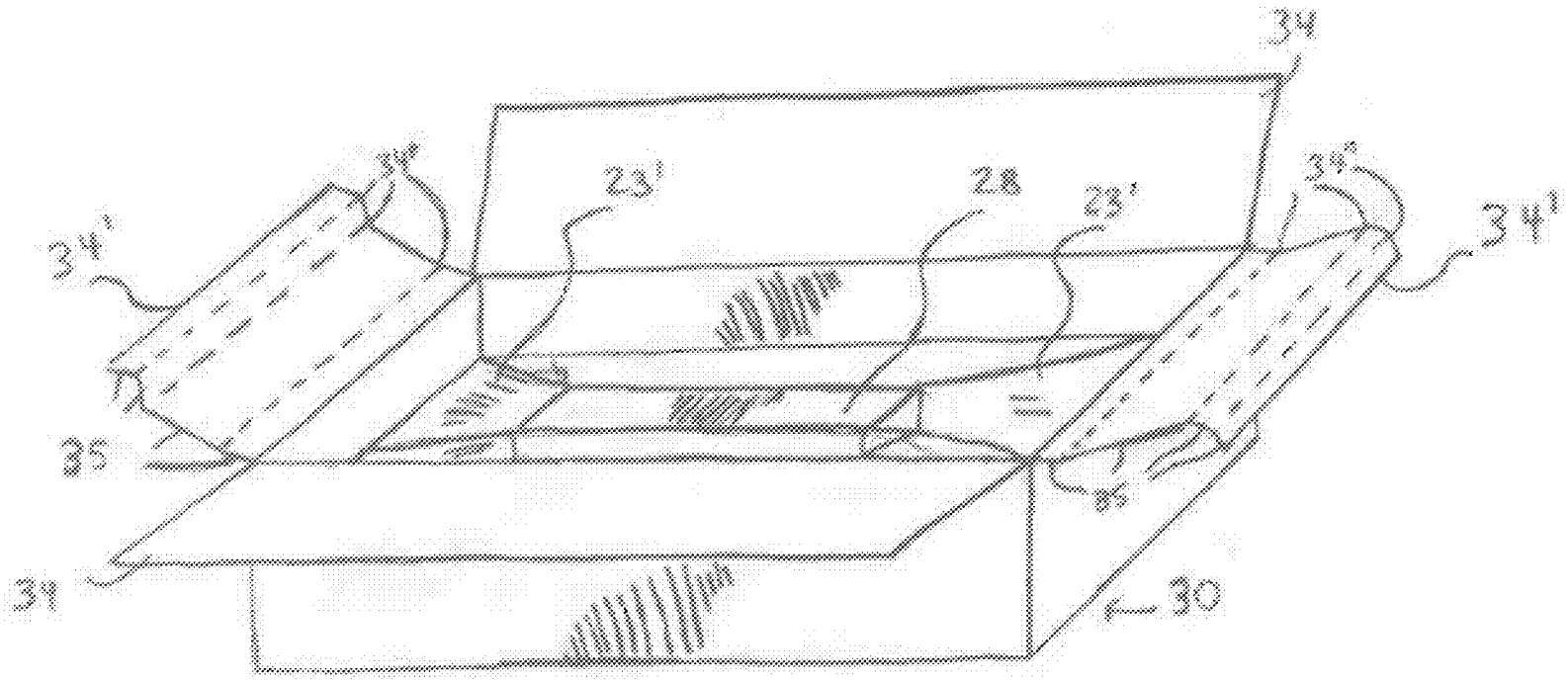
FIG. 24 is a perspective view of another embodiment of the present invention wherein the first platform is disposed within the interior of an exterior container in the retaining position.

With respect to FIG. 24, the exterior container 30 may comprise at least one stabilizing member 34' connected to a corresponding side portion 30' of the exterior container. The confronting engagement of the stabilizing member 34' and the platform, 10 as in FIG. 25 or 12 as in FIG. 26, serves to secure the platform 10, 12 and restrain its movement relative to the exterior container 30, and by extension retain the enclosed article 28 in a fixed relationship relative to the exterior container 30. Additionally, the stabilizing member 34' and platform 10, 12 may be disposed and structured to collectively act as "shock absorbers," absorbing inadvertent trauma etc. exerted on the exterior container 30 and averting transfer of at least a portion of these forces to the enclosed article 28. This may be an alternative or enhancement to the shock absorbing abilities previously discussed above.

Figure 25:
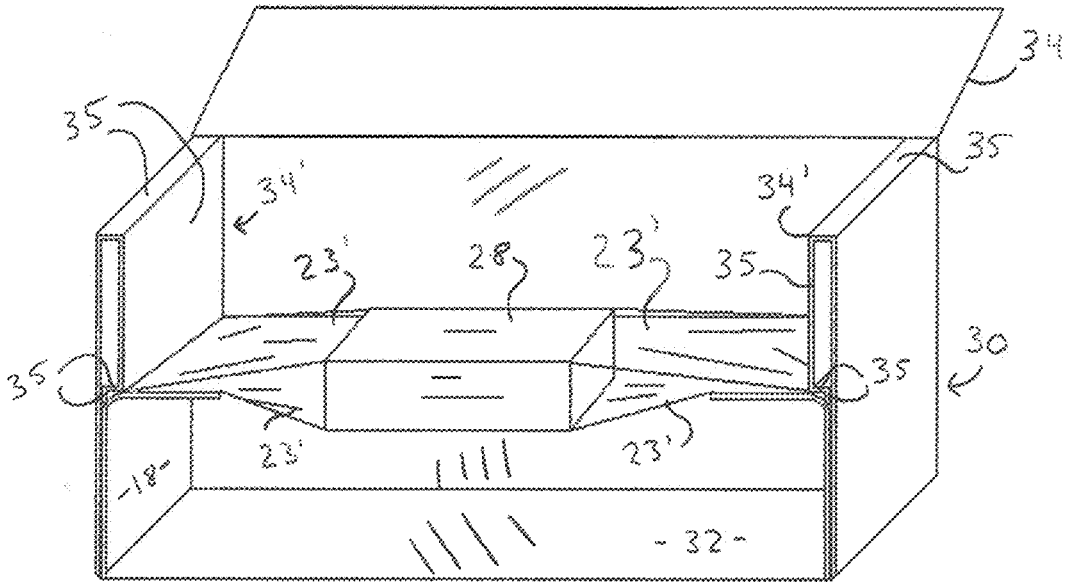
FIG. 25 is an interior sectional view, in perspective, of the embodiment of FIG. 24.
Figure 28:
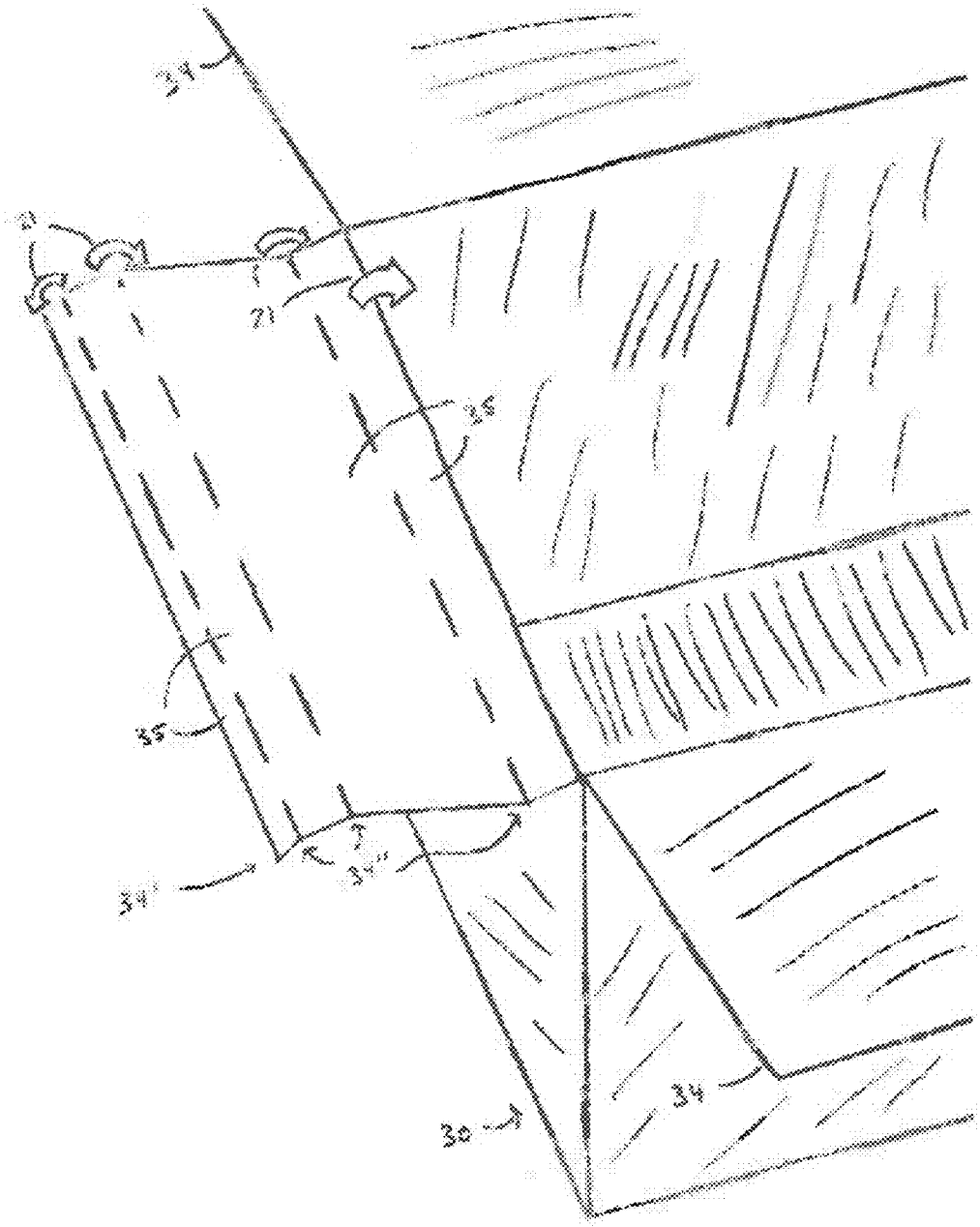
FIG. 28 is an enhanced perspective view in partial cutaway of an exterior container of an embodiment of the present invention.

The stabilizing member 34' comprises a plurality of folds, score lines, creases, etc. 34" defining a plurality of segments 35. The segments 35 of the stabilizing member 34' are independently movable about corresponding folds 34". Segments 35 of the stabilizing member 34' are defined as a part of the stabilizing member 34' extending between any two adjacent folds 34" or a fold 34" and an adjacent edge of the stabilizing member 34'. The folds 34" extend the length of the stabilizing member 34' in the direction of the corresponding side 30' of the exterior container 30. The effect of the plurality of folds 34" and segments 35 is to allow disposition of the stabilizing member 34' within the exterior container 30, as shown in FIGS. 25 and 26. This is achieved by the cooperative movement of the segments 35 about the respective folds 34", achieving an orientation such as that in FIG. 24. FIG. 24, however, is not intended to be a limiting configuration of the respective segments 35 and folds 34" that the stabilizing member 34' may comprise. Instead, it is merely an illustration of one possible configuration thereof. FIG. 28 provides a close up view of the stabilizing member 34' of FIGS. 24 and 25 with directional arrows 21 indicating the direction the segments 35 may be folded or moved into a transverse orientation.

Accordingly, In FIG. 25, an embodiment is shown wherein the stabilizing member 34' is in confronting engagement with the first platform 10, whereas in FIG. 26 the stabilizing member 34' is in confronting engagement with the second platform 12. In the first case, given in FIG. 25, a segment 35 may extend toward the enclosing portion given as 32, between a side 18 of the first platform 12 and the confronting side of the exterior container 30.

Figure 19:
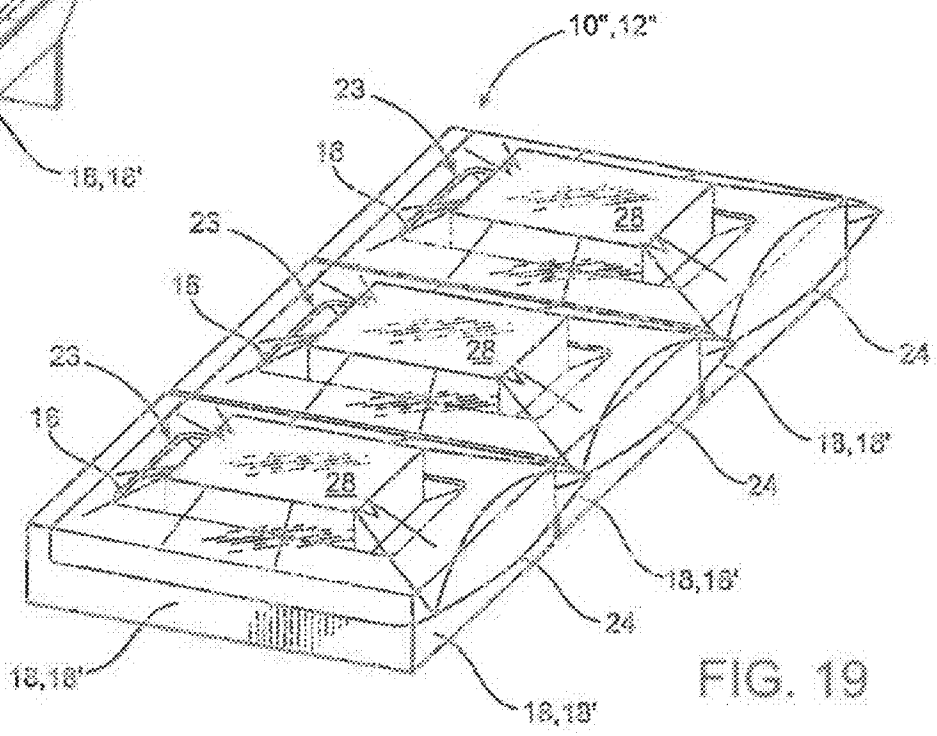
FIG. 19 is a perspective view of yet another preferred embodiment of the present invention representing the packaging assembly being structured to concurrently package a plurality of articles, in a suspended orientation.

Yet another preferred embodiment of the present invention is represented in FIG. 19. In this embodiment both the first and second platforms 10''' and 12''' may include a plurality of windows 16 in a common base 14. As such, FIG. 19 represents the plurality of windows formed in the base 14 of either of the platforms 10''' or 12''' in spaced relation to one another. However, the number, sizes and configurations of the plurality of windows 16 may vary dependent on the articles 28 being enclosed within the bags 23. Further, a plurality of bags 23 are utilized to enclose the articles 28. The access openings 24 of each of the plurality of bags 23 may be connected to corresponding ones of the side portions 18 in the manner associated with the structure of any of the embodiments of FIGS. 1-17. Further, a second platform 12''' may also include the plurality of windows 16, as indicated and may be disposed in the aforementioned and described inverted and retaining position relative to the second platform 12'''.

Figure 29:
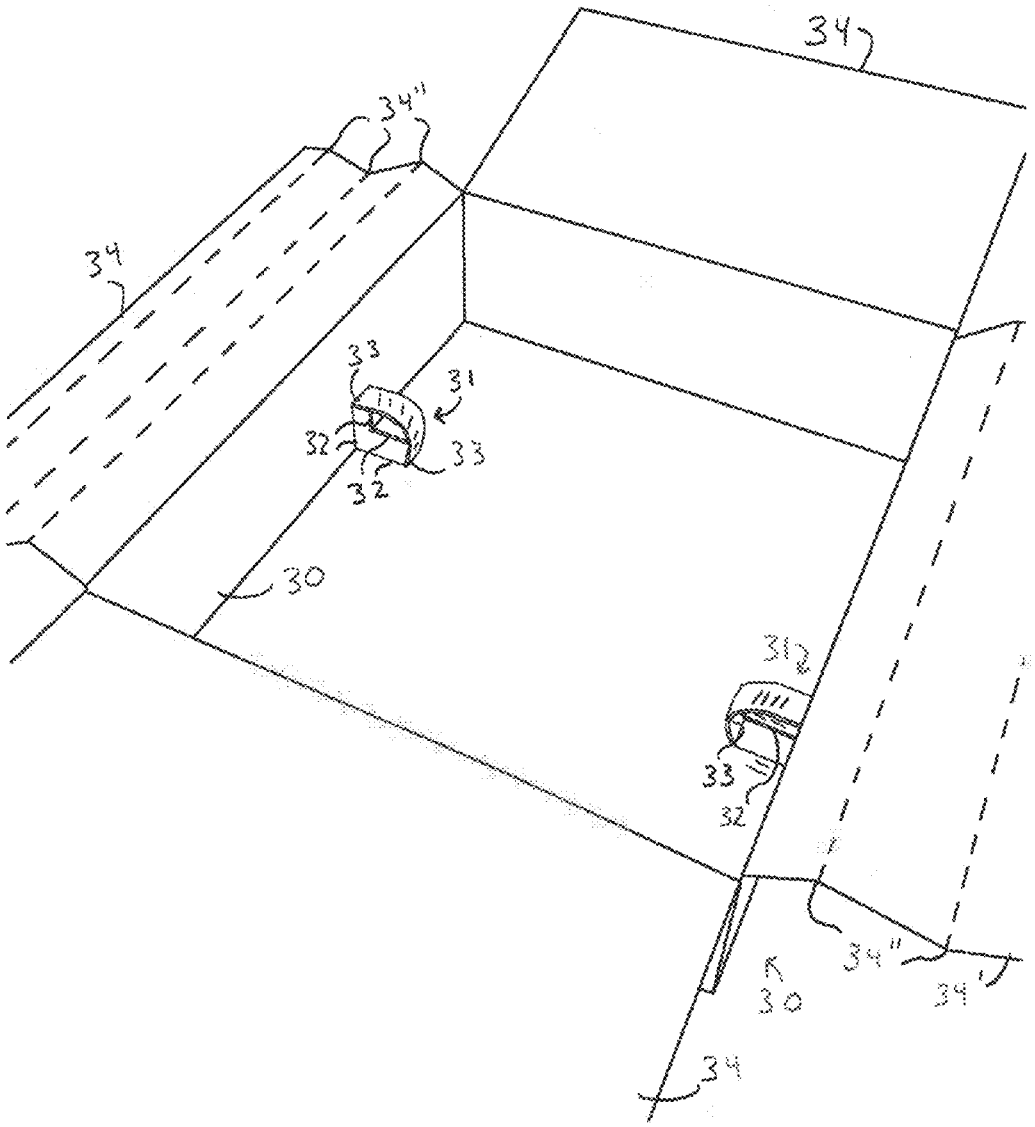
FIG. 29 is an enhanced perspective view in partial cutaway of an exterior container of an embodiment of the present invention.
Figure 31A:
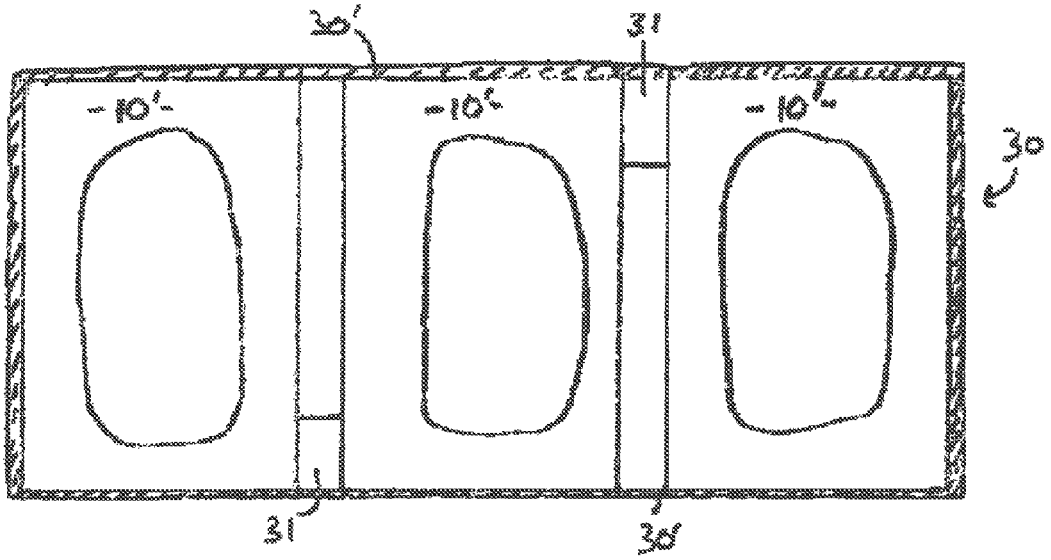
FIG. 31*a* is a schematic representation of an embodiment of the present invention.
Figure 31B:
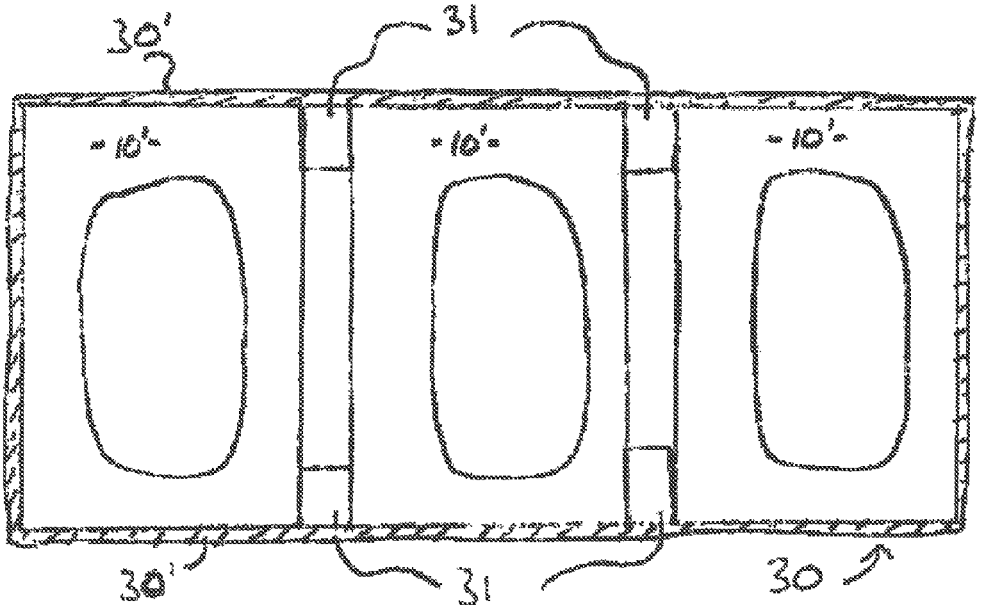
FIG. 31*b* is a schematic representation of an embodiment of the present invention.
Figure 32A:
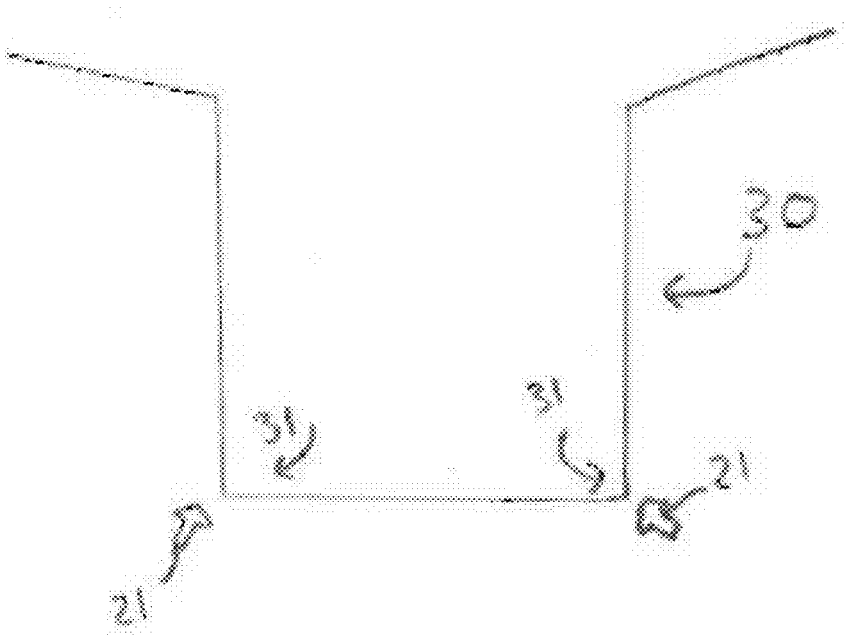
FIG. 32*a* is a schematic representation of an embodiment of the present invention.
Figure 32B:
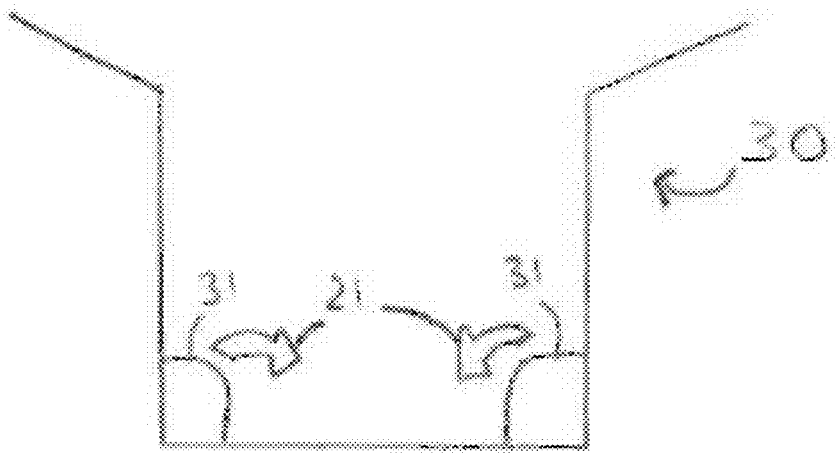
FIG. 32*b* is a schematic representation of the embodiment of FIG. 32*a*.

Yet another preferred embodiment of the present invention is represented in FIG. 29. In this embodiment, the exterior container 30 comprises at least two guides 31 each disposed on an opposing side 30' of the exterior container 30 as shown in FIG. 29. FIGS. 31*a* and 31*b* demonstrate two possible configurations in which a plurality of guides 31 secure a plurality of first platforms 10' within the exterior container 30. With reference to FIG. 29, in at least one embodiment, the guides 31 are a part of the exterior container 30 that "pops out" therefrom as defined by a pair of transverse and opposing score lines 32 and a pair of transverse and opposing creases 33. FIGS. 32*a* and 32*b* demonstrate the non-popped out and popped out states, respectively, of the guides 31 as seen from a schematic side view of the exterior container 30. Returning to FIG. 29, the score lines 32 may alternatively be defined by perforations, cuts, or any other suitable structure for separating or defining the guide 31 from the exterior container 30. The creases 33 may be predefined folds, scores, creases etc., or may be formed by disposition of the guide into the "popped out" state. This disposition can be achieved by, for example, pressing on the outside of the exterior container 30 between the two score lines 32 defining the edge of a guide 31, causing it to "pop out" and be disposed within the exterior container 30. This is shown by arrows 21 in FIG. 32*a*, which show the application of pressure on the outside of the container to deploy the guides 31 into the popped out state. FIG. 32*b* denotes the popped out state of the guides 31 with arrows 21 showing the direction of movement of the guides during deployment. Accordingly, the term "popped out" can be accurately described as an inwardly protruding orientation of the one or more guides 31 into the interior of the exterior container 30. In addition, the term "non-popped out" can be accurately defined as the various portions of each of the guides 31 being disposed in aligned, at least partially coplanar relation with corresponding portions of the sides 30' of the exterior container 30 in which they are formed, as set forth above.

Figure 30:
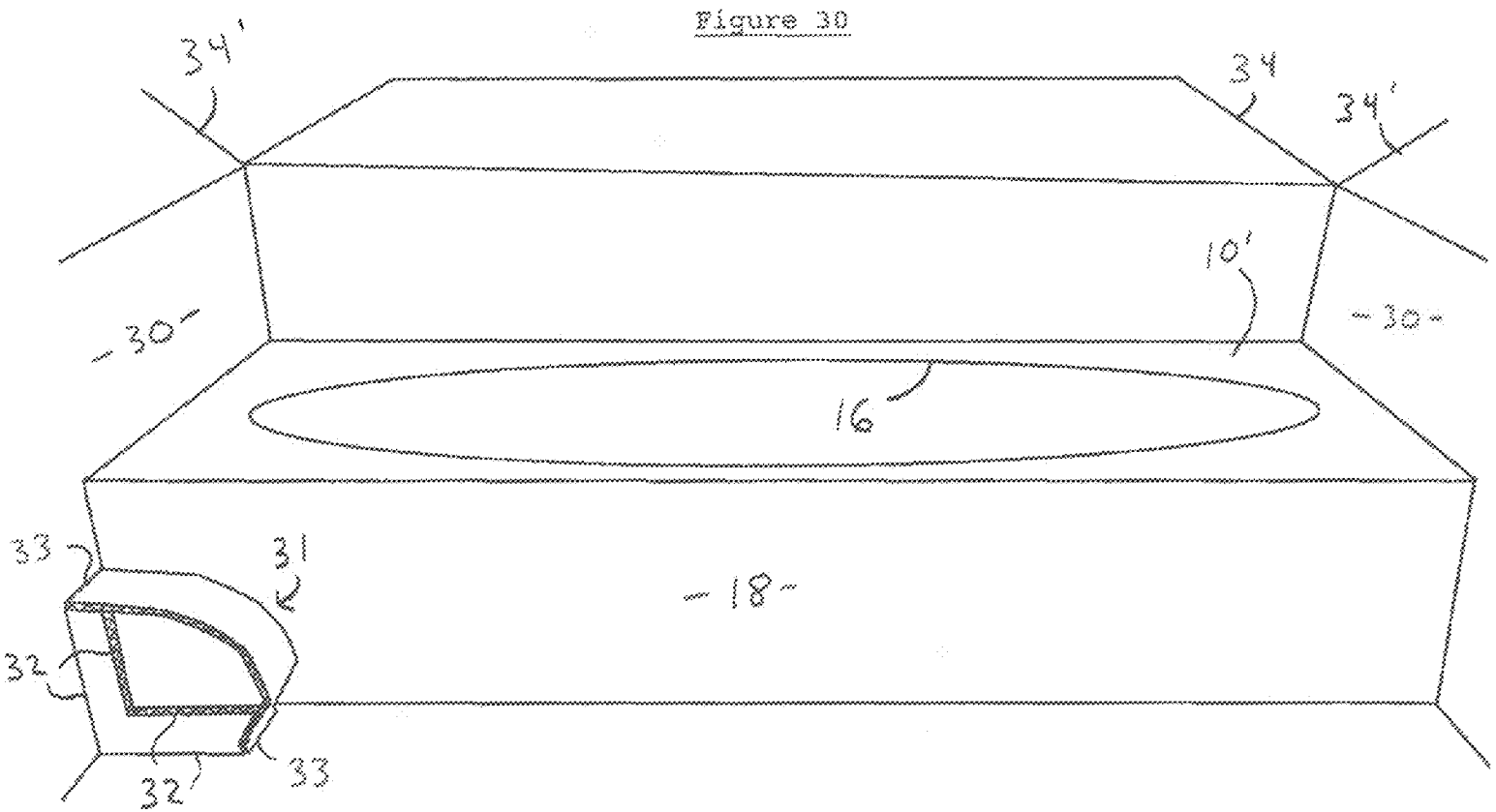
FIG. 30 is an enhanced perspective view in partial cutaway of the exterior container of FIG. 30 in operative placement with a first platform.

With reference to FIG. 30, the guide 31 serves to secure one of a plurality of first platforms 10' against a side 30' of the exterior container 30. This occurs when such first platform 10' is disposed in the interior of the exterior container 30 and the side portions 18 of the first platform 10' are in the transverse orientation relative to the base 14. Each of the plurality of first platforms 10' is placed either between two guides 31 or between a guide 31 and a side of the exterior container 30. In either case, the side portions 18 of the first platforms are in confronting relation with the adjacent guide and/or side of the exterior container 30, as applicable. Thus, the guide 31 facilitates the orderly disposition of a plurality of first platforms 10' within the interior of the exterior container 30. Subsequent to placement of the plurality of first platforms 10' within the exterior container 30, it may be desirable to return the guides 31 to the non-popped-out, original position, which can be accomplished by, for example, applying pressure to the center of the guides 31.

The number of guides 31 may vary depending on the embodiment, but the guides 31 are generally evenly distributed between the two opposing side portions 30' of the exterior container 30 they are connected to. By evenly distributed, what is meant is that if there are two guides, one guide will be on each of the two opposing side portions 30' of the exterior container 30. If there are four, two will be on each side portion 30', etc. In the event that there should be an odd number of guides 31, one side portion 30' may have one more guide 31 than the other, and the guides 31 will still be considered evenly distributed.

Figure 21:
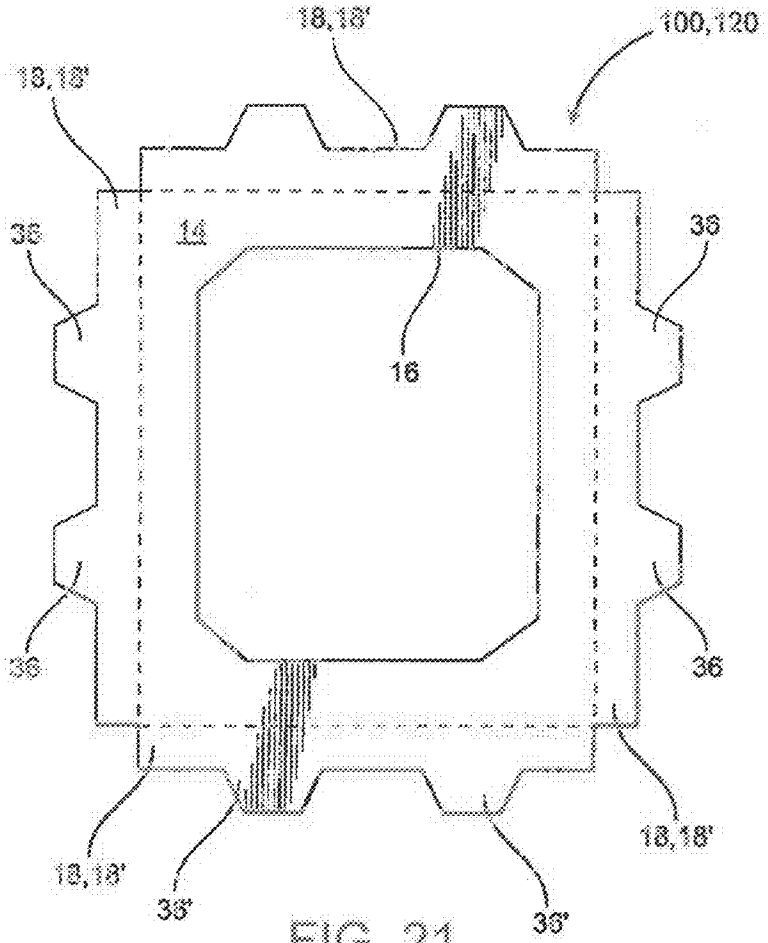
FIG. 21 is a front plan view of the embodiment of FIG. 20 in an open configuration.
Figure 20:
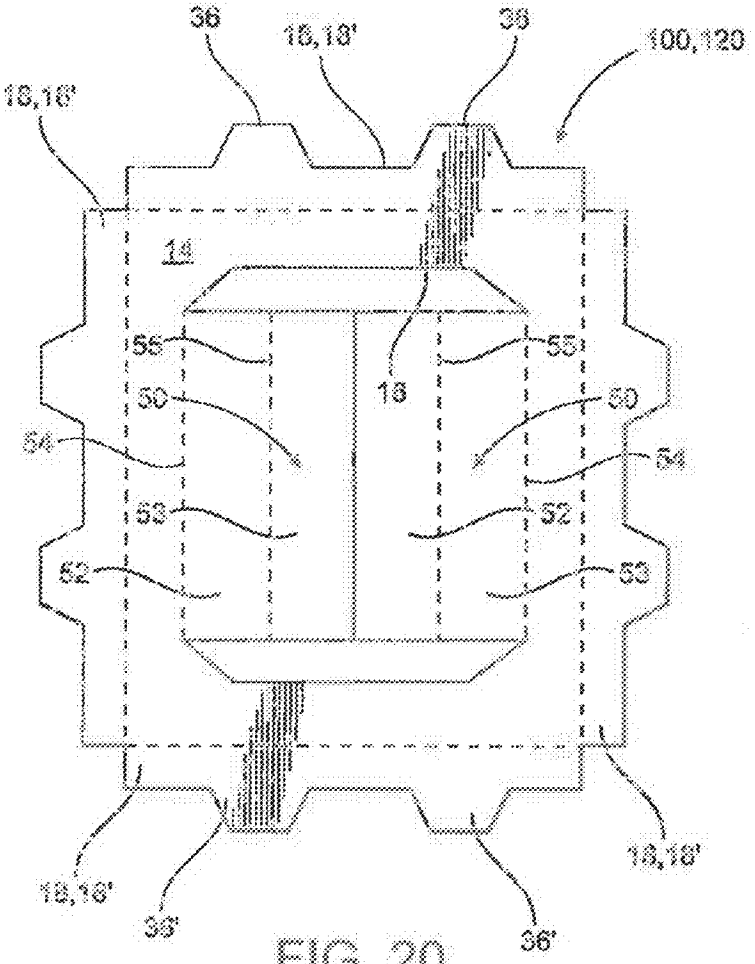
FIG. 20 is a top plan view of yet another preferred embodiment of the first and second platforms.
Figure 22:
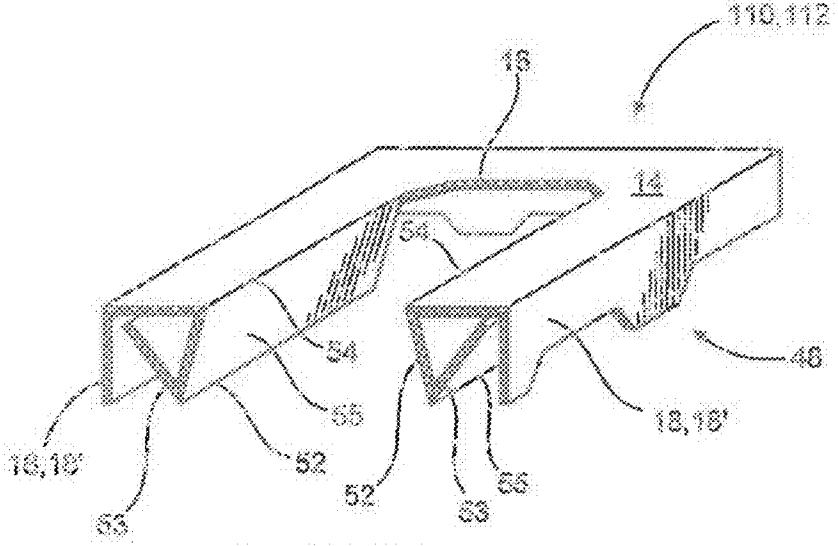
FIG. 22 is a perspective view in section showing interior portions of the embodiment of FIGS. 20 and 21 when in an open configuration.

Yet another preferred embodiment of at least the first platform and in some practical applications both the first and second platforms 100 and 112 is represented in FIGS. 20-22. More specifically, first platform and/or second platform 100 and 112 comprise similar structural features as represented in the embodiments of FIG. 12, including a base 14, a plurality of side portions 18 and/or 18' foldable or otherwise movable about corresponding seams 20 into a transverse orientation relative to the base 14. Similarly, one or more locking tabs 36 may extend about the outer periphery of each of the side portions 18 or 18' so as to interlock or interconnect with corresponding slots 38 of the bag 23", as represented in FIG. 13, 16 or 17.

Accordingly, additional structural features of the first and/or second platforms 100 and 112 include a reinforcing structure generally indicated as 48 in FIG. 22. The reinforcing structure 48 includes the least one panel and/or the plurality of panels 50 individually and/or collectively disposed, at least originally, in a covering position relative to the window(s) 16. In addition, each of the one or more panels 50 include panel segments 52 and 53 separated by a crease, fold line, seam, etc. 55 about which the panels 52 and 53 may be folded relative to one another. Also an additional fold line or seam 54 is disposed along the outer periphery of each of the one or more panels 50, such as along the outer most periphery of the interior panel segment 52. Accordingly, the one or more panels 50, including the panel segments 52 and 53 have a "foldable construction" wherein each of the one or more panels 50 may be disposed out of the closing position, relative to the window 16, and into a reinforcing position, as represented in FIG. 22. As such, the plurality of panel segments 52 and 53 are folded along the fold line or seam 54 relative to the base 14 and also foldable along the inner most fold line or seam 55 relative to one another.

Therefore when in the reinforcing position of FIG. 22, panel segment 52 is disposed in a supporting and/or "wedged" orientation in confronting relation to the under surface of the base 14, as represented, as well as the inner surface of the correspondingly disposed side portion 18 or 18'. In cooperation therewith, the corresponding panel segments 53 are disposed in a downward, somewhat angled orientation such that the fold line or seam 55 is disposed in substantially aligned relation with the outer most periphery of the side portion 18 or 18'. Therefore, when in the reinforcing position of FIG. 22 and further when the first and second platforms 100 and/or 112 are disposed within the exterior container 30, fold line or seam 55 will generally confront interior surfaces of the exterior container 30. As a result, additional reinforcement or "shock absorbing" characteristics will be provided to the base 14 as well as any article 28 contained within the bag 23 and suspended within the window 16 of either the first and second platforms 100 and/or 112.

Figure 23:
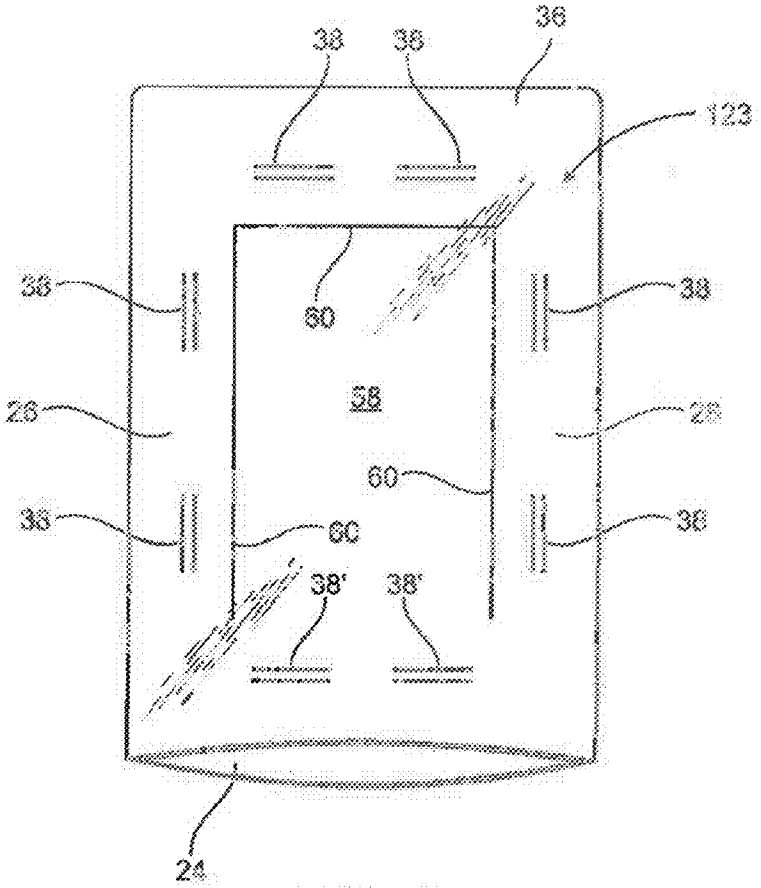
FIG. 23 is a top perspective view of yet another embodiment of the bag of the present invention.

Yet an additional preferred embodiment is represented in FIG. 23 wherein a bag 123 is used in combination with any of the first and second platforms of the embodiments of FIGS. 1-22. More specifically, the bag 123 includes a compartment generally indicated as 58 which is at least partially segregated from at least some of the remaining portions, as at 26, of the interior of the bag 123. More specifically, the compartment 58 includes an elongated segregating seam or seal structure 60 extending along at least a majority of the periphery of the compartment 58. This seam or seal structure 60 may be a continuous seal or seam such as, but not limited to, the type formed by heat sealing techniques. Alternatively the seal or seam 60 may include a plurality of seal or seam segments disposed in spaced relation to one another but still maintaining an at least partially segregated relation to the other and/or remaining portions 26 of the interior of the bag 123. Also the compartment 58 is disposed in communicating relation to the access opening 24 so as to facilitate the placement of any of a variety of articles 28 within the interior of the compartments 58.

Due to this segregated construction of the compartment 58 any article 28 contained on the interior thereof will be better retained so as to not shift or inadvertently move within the interior of the bag 123, due to the presence of the seal or seam 60 extending along at least the majority of the periphery of the compartment 58.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A packaging assembly structured to suspend an article within an exterior container, said packaging assembly comprising:

a first platform including a base and having at least one window extending therethrough, said first platform further including a plurality of side portions extending about the periphery of the base, each of said side portions independently disposable in a transverse orientation relative to said base, a flexible material bag connected to said first platform and including at least one access opening, said bag and said first platform cooperatively dimensioned and structured to enclose the article within said bag through said access opening and in aligned relation to said window of said first platform, at least one peripheral portion of said bag connected to a corresponding side portion of said first platform and movable therewith into said transverse orientation, and at least one stabilizing member connected to a side portion of the exterior container and disposable therein in a transverse orientation relative to the side portion of the exterior container, said stabilizing member structured to restrict the movement of the enclosed article relative to the exterior container, a second platform including a base having at least one window extending therethrough, said second platform disposed in an inverted, retaining position, in confronting relation to said first platform, on an interior of the exterior container;

said at least one stabilizing member and said second platform cooperatively dimensioned and structured for disposition of said at least one stabilizing member in a confronting relation to said second platform when said at least one stabilizing member is disposed within the exterior container;

said at least one stabilizing member and said second platform cooperatively disposed and structured to restrict the movement of the enclosed article relative to the exterior container upon disposition of said at least one stabilizing member within the exterior container; and said access opening being disposed in a closed orientation, in connected relation to a corresponding one of said side portions of said first platform and movable therewith into said transverse orientation.

2. An assembly as recited in claim 1 wherein said at least one stabilizing member and said first platform are cooperatively dimensioned and structured for disposition of said stabilizing member in a confronting relation with said first platform upon disposition of said at least one stabilizing member within the exterior container.

3. An assembly as recited in claim 2 wherein said at least one stabilizing member and said first platform are cooperatively disposed and structured to restrict the movement of the enclosed article relative to the exterior container upon disposition of said at least one stabilizing member within the exterior container.

4. An assembly as recited in claim 2 wherein said at least one stabilizing member and said side portions of said first platform are disposed and structured to define shock absorbing structures for said bag and the enclosed article.

5. An assembly as recited in claim 1 wherein said at least one stabilizing member and said side portions of said second platform are disposed and structured to define shock absorbing structures for said bag and the enclosed article.

6. An assembly as recited in claim 1 wherein said retaining position further comprises said bases of said first and second platforms disposed in confronting relation to one another and said bag being disposed in sandwiched relation between said bases.

7. An assembly as recited in claim 6 wherein said retaining position further comprises said windows of said first and second platforms disposed in aligned relation to one another.

8. An assembly as recited in claim 7 wherein said sandwiched relation at least partially defines a tensioning of the enclosed article and at least portions of said bag disposed in surrounding relation to the enclosed article.

9. An assembly as recited in claim 6 wherein said sandwiched relation at least partially defines a tensioning of the enclosed article and at least portions of said bag disposed in surrounding relation to the enclosed article.

10. An assembly as recited in claim 1 wherein said bag comprises a plurality of peripheral portions each connected to and movable with a correspondingly disposed one of said side portions of said first platform into said transverse orientation.

11. An assembly as recited in claim 10 wherein said access opening is disposed independent of and in spaced relation to said plurality of peripheral portions, said access opening disposable in a closed orientation between a corresponding side portion of said first platform and an interior surface of the exterior container.

12. A packaging assembly structured to suspend an article within an exterior container, said packaging assembly comprising:

a first platform including a base and having at least one window extending therethrough, said first platform further including a plurality of side portions extending about the periphery of the base, each of said side portions independently disposable in a transverse orientation relative to said base, a flexible material bag connected to said first platform and including at least one access opening, said bag and said first platform cooperatively dimensioned and structured to enclose the article within said bag through said access opening and in aligned relation to said window of said first platform, at least one peripheral portion of said bag connected to a corresponding side portion of said first platform and movable therewith into said transverse orientation, and at least one stabilizing member connected to a side portion of the exterior container and disposable therein in a transverse orientation relative to the side portion of the exterior container, said stabilizing member structured to restrict the movement of the enclosed article relative to the exterior container, a second platform including a base having at least one window extending therethrough, said second platform disposed in an inverted, retaining position, in confronting relation to said first platform, on an interior of the exterior container;

said at least one stabilizing member and said second platform are cooperatively dimensioned and structured for disposition of said at least one stabilizing member in a confronting relation to said second platform when said at least one stabilizing member is disposed within the exterior container;

said at least one stabilizing member and said second platform are cooperatively disposed and structured to restrict the movement of the enclosed article relative to the exterior container upon disposition of said at least one stabilizing member within the exterior container;

said bag including a plurality of peripheral portions each connected to and movable with a correspondingly disposed one of said side portions of said first platform into said transverse orientation; and said access opening disposed independent of and in spaced relation to said plurality of peripheral portions, said access opening disposable in a closed orientation between a corresponding side portion of said first platform and an interior surface of the exterior container.

* * * * *